US007656752B2

(12) United States Patent
Arita et al.

(10) Patent No.: US 7,656,752 B2
(45) Date of Patent: Feb. 2, 2010

(54) DIAL PLATE UNIT WITH INDICATING MEMBERS AND DIAL PLATE, AND DEVICE WITH THE DIAL PLATE UNIT

(75) Inventors: Kohki Arita, Fussa (JP); Junichi Sato, Hino (JP); Takanobu Kanezashi, Hachioji (JP); Yoshihiro Maruyama, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 12/212,924

(22) Filed: Sep. 18, 2008

(65) Prior Publication Data

US 2009/0080294 A1 Mar. 26, 2009

(30) Foreign Application Priority Data

Sep. 20, 2007 (JP) ..... 2007-243214

(51) Int. Cl.
*G04B 25/00* (2006.01)
*G04B 19/06* (2006.01)
*G04C 17/00* (2006.01)

(52) U.S. Cl. ..... 368/223; 368/232

(58) Field of Classification Search ..... 368/10, 368/80, 88, 110–113, 223, 228, 232, 276, 368/281; 116/245, 284, 286; 362/482, 546
See application file for complete search history.

(56) References Cited

U.S. PATENT DOCUMENTS 4,436,435 A * 3/1984 Ushikoshi ..... 368/71
4,706,238 A * 11/1987 Kizawa ..... 368/296
5,802,016 A * 9/1998 Kubota et al. ..... 368/11
6,275,450 B1 * 8/2001 Makiba ..... 368/80
6,894,951 B1 * 5/2005 Brandt et al. ..... 368/80
6,925,032 B2 * 8/2005 Willemin et al. ..... 368/28
6,975,562 B2 * 12/2005 Lizzi ..... 368/69
7,072,246 B2 * 7/2006 Lizzi ..... 368/10
7,215,601 B2 * 5/2007 Plancon et al. ..... 368/10
2007/0086276 A1 * 4/2007 Furukawa et al. ..... 368/80

FOREIGN PATENT DOCUMENTS

WO WO 99/18479 A1 4/1999

* cited by examiner

*Primary Examiner*—Vit W Miska
(74) *Attorney, Agent, or Firm*—Frishauf, Holtz, Goodman & Chick, P.C.

(57) ABSTRACT

A dial plate unit includes a dial plate provided with an outside dial plate element having an opening, an inside dial plate element spaced at a predetermined distance from the outside dial plate element, and a frame member provided in the opening of the outside dial plate element and closing a gap between the periphery of the opening and a part of the inside dial plate element corresponding to the periphery of the opening. The unit further includes one indicating member disposed in a side of the outside dial plate element opposite to the inside dial plate element and being movable along the outside dial plate element, and one auxiliary indicating member disposed in the opening and being movable between the outside and inside dial plate elements. A device using the dial plate unit includes a indicating member operating module which operates the indicating member and auxiliary indicating member.

17 Claims, 11 Drawing Sheets

DIAL PLATE UNIT WITH INDICATING MEMBERS AND DIAL PLATE, AND DEVICE WITH THE DIAL PLATE UNIT

CROSS-REFERENCE TO RELATED APPLICATIONS

This application is based upon and claims the benefit of priority from prior Japanese Patent Application No. 2007-243214, filed Sep. 20, 2007, the entire contents of which are incorporated herein by reference.

BACKGROUND OF THE INVENTION

1. Field of the Invention

The present invention relates to a dial plate unit with indicating members and a dial plate and an device with the dial plate unit.

2. Description of the Related Art

WO99/18479 discloses a wrist watch comprising a dial plate including an inside dial plate element, which is provided with a time indicating portion and a plurality of auxiliary indicating portions, and an outside dial plate element, which overlaps the inside dial plate element and in which a plurality of openings corresponding to the time indicating portion and the plurality of auxiliary indicating portions on the inside dial plate element are formed. The wrist watch further comprises a plurality of indicating members or single indicating member corresponding to each of the time indicating portion and the plurality of auxiliary indicating portions of the inside dial plate element, and a indicating member operating module for operating these indicating members. The dial plate, together with the indicating members and the indicating member operating module, is disposed at a predetermined position of a watch case of the wrist watch.

In this conventional watch, the inside dial plate element and the outside dial plate element are intimately in contact with each other, so that a height difference between each of the time indicating portion and the plural auxiliary indicating portions on the inside dial plate element and the outer surface of the outside dial plate element is small to make a three-dimensional appearance of the dial plate being poor.

BRIEF SUMMARY OF THE INVENTION

According to one aspect of the present invention, a dial plate unit comprises: a dial plate including an outside dial plate element which has a first surface and a second surface facing in an opposite direction to the first surface and in which an opening is formed at least one predetermined position, an inside dial plate element which is spaced at a predetermined distance from the second surface of the outside dial plate element and which is arranged to face the second surface, and a frame member which is provided in the opening of the outside dial plate element and which close a gap between at least a part of the periphery of the opening and at least a part of the inside dial plate element corresponding to the at least a part of the periphery of the opening; at least one indicating member which is disposed in a side of the first surface of the outside dial plate element and which is movable along the first surface; and at least one auxiliary indicating member which is disposed in the opening and which is movable between the outside dial plate element and the inside dial plate element.

According to another aspect of the present invention, a device comprises: a dial plate including an outside dial plate element which has a first surface and a second surface facing in an opposite direction to the first surface and in which an opening is formed at least one predetermined position, an inside dial plate element which is spaced at a predetermined distance from the second surface of the outside dial plate element and which is arranged to face the second surface, and a frame member which is provided in the opening of the outside dial plate element and which close a gap between at least a part of the periphery of the opening and at least a part of the inside dial plate element corresponding to the at least a part of the periphery of the opening; at least one indicating member which is disposed in a side of the first surface of the outside dial plate element and which is movable along the first surface; at least one auxiliary indicating member which is disposed in the opening and which is movable between the outside dial plate element and the inside dial plate element; and a indicating member operating module which operates the indicating member and auxiliary indicating member.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Hereinafter, a device with a dial plate unit according to a first embodiment of the present invention will be described with reference to FIGS. 1 to 8.

Figure 1:
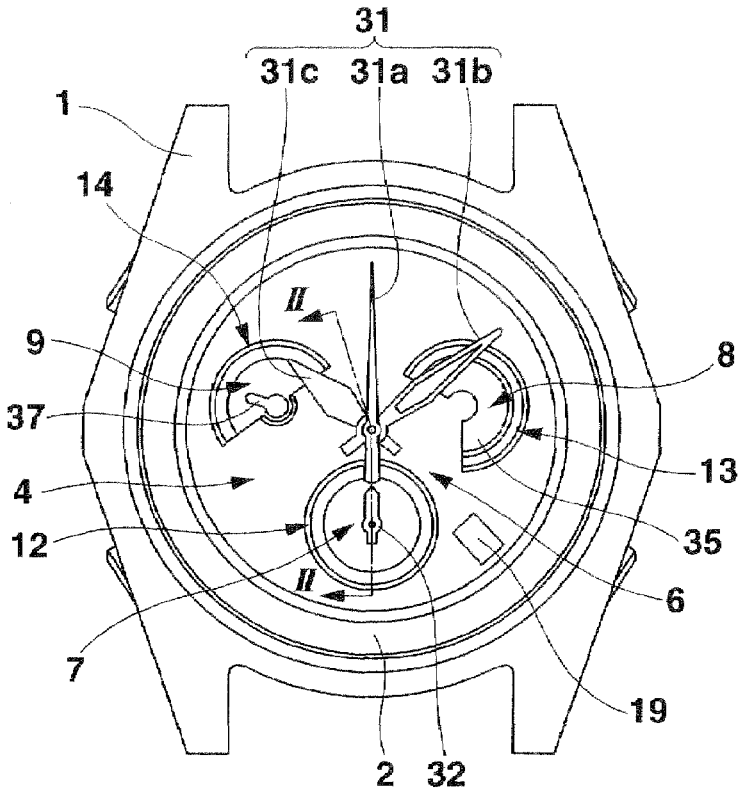
FIG. 1 is a plan view of a wrist watch using a dial plate unit according to a first embodiment of the present invention.

In this embodiment, the aforementioned device is a wrist watch which is one kind of a portable timepiece, and, as shown in FIG. 1, comprises a wrist watch case 1 as a portable timepiece case. The wrist watch case 1 includes an inner space opened in front and back surfaces thereof. A device main body is housed in the inner space. The opening of the back surface of the wrist watch case 1 is covered with a back cover detachably fixed to the back opening. The opening of the front surface of the wrist watch case 1 is covered with a watch glass 2 as a light transmission plate, fixed to the front opening.

Figure 2:
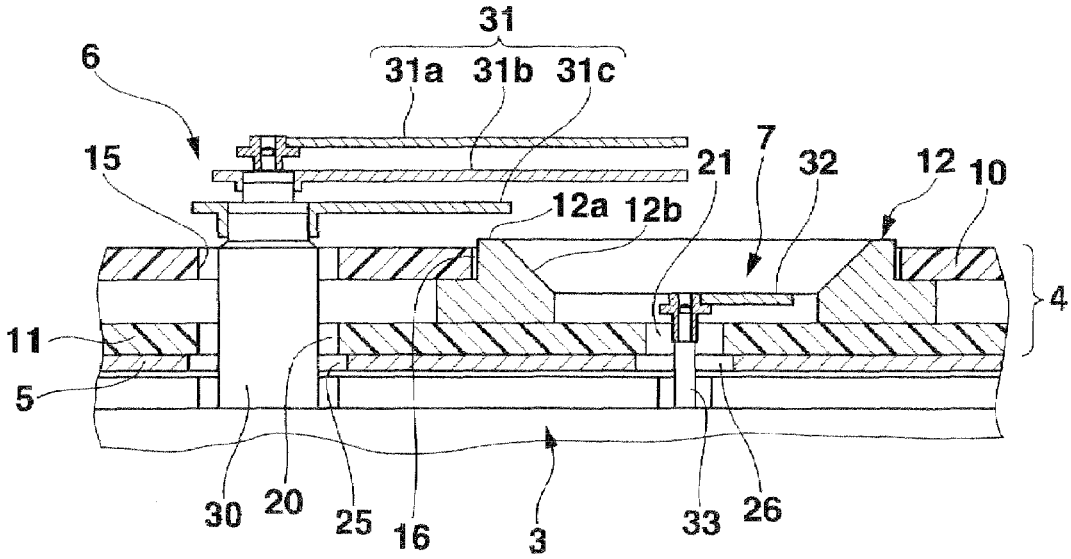
FIG. 2 is a schematic sectional view taken along a line II-II of FIG. 1.
Figure 3:
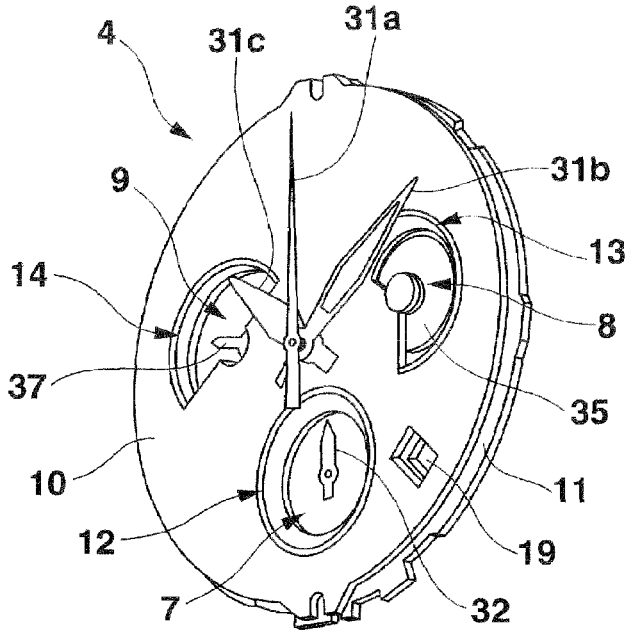
FIG. 3 is an enlarged perspective view showing the dial plate unit of FIG. 1.

As shown in FIGS. 1 to 3, the device main body in the inner space of the wrist watch case 1 is provided with an indicating member operating module 3 which is disposed adjacent the back cover described above and not shown and which includes a time counting module, a light transmitting dial plate 4 which is disposed to face the watch glass 2, and a solar panel 5 which is disposed between the dial plate 4 and the indicating member operating module 3. A time indicating portion 6 which indicates a time, and first to third auxiliary indicating portions 7, 8, and 9 are provided on an outside surface of the dial plate 4 facing the watch glass 2.

Figure 4:
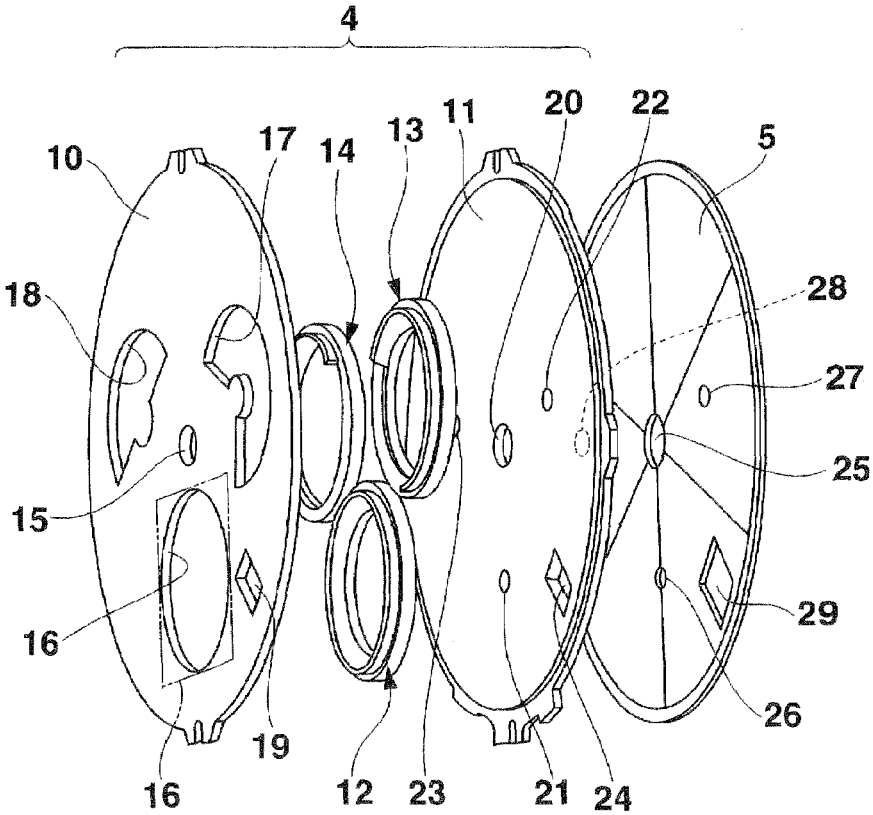
FIG. 4 is an exploded perspective view of a dial plate of the dial plate unit of FIG. 3.
Figure 5:
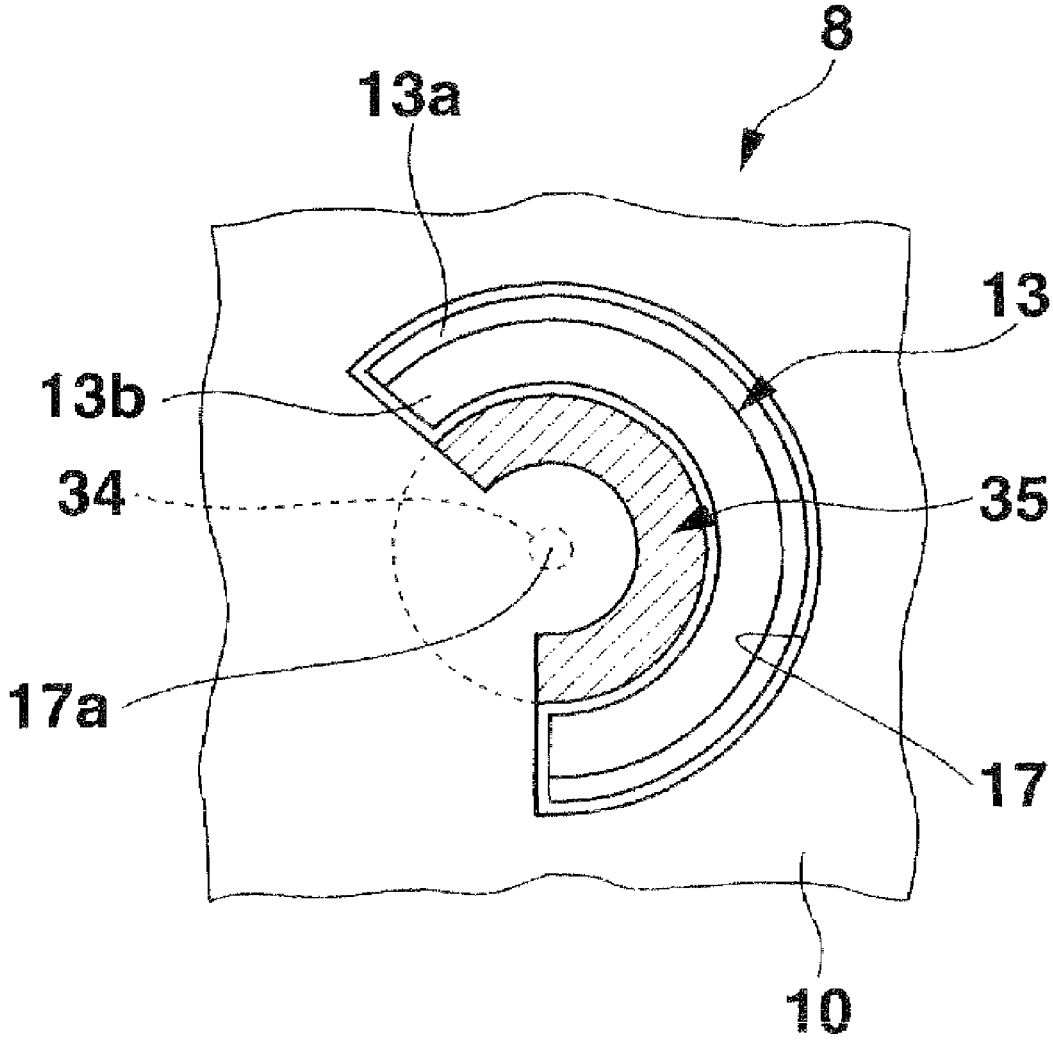
FIG. 5 is an enlarged front view showing a second auxiliary indicating portion of the dial plate of the dial plate unit of FIGS. 1 and 3 and its surrounding area.

As shown in FIGS. 2 to 4, the dial plate 4 includes an outside dial plate element 10 which has a first surface (outside surface) and a second surface (inside surface) facing in an opposite direction to the first surface, an inside dial plate element 11 which is spaced at a predetermined distance from the second surface of the outside dial plate element 10 and which is arranged to face the second surface, and first to third frame members 12, 13, and 14 disposed between the outside dial plate element 10 and the inside dial plate element 11 at plural predetermined positions corresponding to the first to third auxiliary indicating portions 7, 8, and 9.

In this embodiment, the outside dial plate element 10 is formed of transparent or translucent plastic such as polycarbonate (PC) or polymethyl metharylate (PMMA) to have a substantially circular disk shape. A plurality of time marks is displayed on a peripheral area of the first surface of the outside dial plate element 10. In this embodiment, the number of time marks is twelfth.

An indicating member driving shaft insertion hole 15 is formed in the center of the outside dial plate element 10 as shown in FIGS. 2 and 4. First to third openings 16, 17, and 18 are formed in the outside dial plate element 10 at the above-described plural predetermined positions corresponding to the first to third auxiliary indicating portions 7, 8, and 9. In this embodiment, the above-described plural predetermined positions are 6 o'clock, 2 o'clock, and 10 o'clock positions as shown in FIGS. 3 and 4. Each of the first to third openings 16, 17, and 18 may have a shape selected from the group consisting of a circle, a fan and a polygon.

The first opening 16 at the 6 o'clock position has a circular shape as shown in FIGS. 3 and 4. The second opening 17 at the 2 o'clock position has a fan-like shape having a spreading angle of 240°. The third opening 18 at the 10 o'clock has a fan-like shape having a spreading angle of 180° (namely, semi-circular shape).

In this embodiment, an indicating window 19 is formed at a 5 o'clock position of the outside dial plate element 10. The indicating window 19 has a square shape.

Like the outside dial plate element 10, the inside dial plate element 11 is formed of transparent or translucent plastic such as polycarbonate (PC) or polymethyl metharylate (PMMA) to have a substantially circular disk shape. The outer diameter of the inside dial plate element 11 is substantially the same as the outer diameter of the outside dial plate element 10.

As shown in FIGS. 2 and 4, an indicating member driving shaft insertion hole 20 is formed in the center of the inside dial plate element 11 to be coaxial with the indicating member driving shaft insertion hole 15 of the outside dial plate element 10. As shown in FIG. 4, first to third auxiliary driving shaft insertion holes 21, 22 and 23 are formed in areas of the inside dial plate element 11, these areas corresponding to the first to third openings 16, 17 and 18 of the outside dial plate element 10. Further, a square shaped indication opening 24 is formed in the inside dial plate element 11 to correspond to the indicating window 19 of the outside dial plate element 10.

The first to third frame members 12, 13 and 14 are formed of anticorrosion metal such as brass, aluminum, or the like, or plastic, and are provided in the first to third openings 16, 17 and 18 of the outside dial plate element 10. Each of the first to third frame members 12, 13 and 14 closes a gap between at least a part of the periphery of each of the first, second and third openings 16, 17 and 18 corresponding thereto and at least a part of the inside dial plate element 11 corresponding to the at least a part of the periphery of each of the first, second and third openings 16, 17 and 18.

As shown in FIGS. 1 to 4, the first frame member 12 is formed into a circularly annular shape corresponding to the periphery of the circular first opening 16 at the 6 o'clock position in the outside dial plate element 10. The first frame member 12 has an outer peripheral surface the diameter of which is larger than that of the periphery of the first opening 16 and an inner peripheral surface the diameter of which is smaller than that of the periphery of the first opening 16, and a height between an outside end (top surface) and an inside end (bottom surface) in the first frame member 12 is substantially the same as that of the gap between the second surface (inside surface) of the outside dial plate element 10 and the outside surface of the inside dial plate element 11. An outer projection 12*a* is formed on a part of the outside end (top surface) of the first frame member 12, the part corresponding to the periphery of the first opening 16, to project outward along the inner peripheral surface of the first frame member 12.

The outer peripheral surface of the outer projection 12*a* has the same diameter and height as those of the periphery of the first opening 16, and the outside end (top surface) of the first frame member 12 provides a step between the outer peripheral surface of the outer projection 12*a* and the outer peripheral surface of the first frame member 12.

When the outer projection 12*a* of the first frame member 12 is inserted into the first opening 16 of the outside dial plate element 10 from the second surface (inside surface) side of the outside dial plate element 10, as shown in FIG. 2, the outer peripheral surface of the first frame member 12 comes in contact with the periphery of the first opening 16 and an area excluding the outer projection 12*a* on the outside end (top surface) of the first frame member 12 comes in contact with the second surface (inside surface) of the outside dial plate element 10, so that the first frame member 12 is positioned to the first opening 16 on the second surface (inside surface) of the outside dial plate element 10. Further, the whole of the circularly annular shaped inside end (bottom surface) of the first frame member 12 comes in contact with the outside surface of the inside dial plate element 11. As a result, the first frame member 12 closes the gap between the entire periphery of the first opening 16 of the outside dial plate element 10 and a portion corresponding to the entire periphery of the first opening 16 on the outside surface of the inside dial plate element 11.

The inner peripheral surface 12*b* of the first frame member 12 is tapered so that its diameter increases gradually from an inside end (bottom surface) of the first frame member 12 toward an projecting end (top surface) of the outer projection 12*a*. The tapered inner peripheral surface 12*b* may have a decoration layer. The decoration layer may be provided by any known decoration treatment including engraving, printing, painting, plating, vapor deposition, etc.

As shown in FIGS. 3 and 4, the second frame member 13 is formed into a circularly annular shape coaxial with the center of an arc (namely, the pivot of the fan) which is a part of the periphery of the second opening 17 of the fan shape spreading over 240° located at the 2 o'clock position in the outside dial plate element 10. The second frame member 13 has an outer peripheral surface the diameter of which is larger than that of the arc of the second opening 17 and an inner peripheral surface the diameter of which is smaller than that of the arc of the second opening 17, and a height between an outside end (top surface) and an inside end (bottom surface) in the second frame member 13 is substantially the same as that of the gap between the second surface (inside surface) of the outside dial plate element 10 and the outside surface of the inside dial plate element 11.

An arc shaped outer projection 13*a* is formed on a part of the outside end (top surface) of the second frame member 13, the part corresponding to the arc as the part of the periphery of the second opening 17, to project outward along a part of the inner peripheral surface of the second frame member 13, the part corresponding to the arc as the part of the periphery of the second opening 17, up to the height which is substantially the same as the thickness of the outside dial plate element 10.

When the outer projection 13*a* of the second frame member 13 is inserted into the second opening 17 of the outside dial plate element 10 along the arc of the one part of the periphery of the second opening 17 from the second surface (inside surface) side of the outside dial plate element 10, the outer peripheral surface of the second frame member 13 comes in contact with the arc of the one part of the periphery of the second opening 17 and an area excluding the outer projection 13*a* on the outside end (top surface) of the second frame member 13 comes in contact with the second surface (inside surface) of the outside dial plate element 10, so that the second frame member 13 is positioned to the second opening 17 on the second surface (inside surface) of the outside dial plate element 10. Further, the whole of the circularly annular shaped inside end (bottom surface) of the second frame member 12 comes in contact with the outside surface of the inside dial plate element 11. As a result, the second frame member 13 closes the gap between the arc of the one part of the periphery of the second opening 17 of the outside dial plate element 10 and a portion corresponding to the arc of the one part of the periphery of the second opening 17 on the outside surface of the inside dial plate element 11.

The inner peripheral surface 13*b* of the second frame member 13 is tapered so that its diameter increases gradually from an inside end (bottom surface) of the second frame member 13 toward a projecting end (top surface) of the outer projection 13*a*. The tapered inner peripheral surface 13*b* may have a decoration layer. The decoration layer may be provided by any known decoration treatment including engraving, printing, painting, plating, vapor deposition, etc.

As shown in FIGS. 3 and 4, the third frame member 14 is formed into a circularly annular shape coaxial with the center of an arc (namely, the pivot of the fan) which is a part of the periphery of the third opening 18 of the fan shape spreading over 180° located at the 10 o'clock position in the outside dial plate element 10. The third frame member 14 has an outer peripheral surface the diameter of which is larger than that of the arc of the third opening 18 and an inner peripheral surface the diameter of which is smaller than that of the arc of the third opening 18.

A height between an outside end (top surface) and an inside end (bottom surface) in the third frame member 14 is substantially the same as that of the gap between the second surface (inside surface) of the outside dial plate element 10 and the outside surface of the inside dial plate element 11.

An arc shaped outer projection 14*a* is formed on a part of the outside end (top surface) of the third frame member 14, the part corresponding to the arc as the part of the periphery of the third opening 18, to project outward along the part of the inner peripheral surface of the third frame member 14, the part corresponding to the arc as the part of the periphery of the third opening 18, up to the height which is substantially the same as the thickness of the outside dial plate element 10.

When the outer projection 14*a* of the third frame member 14 is inserted into the third opening 18 of the outside dial plate element 10 along the arc of the one part of the periphery of the third opening 18 from the second surface (inside surface) side of the outside dial plate element 10, the outer peripheral surface of the third frame member 14 comes in contact with the arc of the one part of the periphery of the third opening 18 and an area excluding the outer projection 14*a* on the outside end (top surface) of the third frame member 14 comes in contact with the second surface (inside surface) of the outside dial plate element 10, so that the third frame member 14 is positioned to the third opening 18 on the second surface (inside surface) of the outside dial plate element 10. Further, the whole of the circularly annular shaped inside end (bottom surface) of the third frame member 13 comes in contact with the outside surface of the inside dial plate element 11. As a result, the third frame member 14 closes the gap between the arc of the one part of the periphery of the third opening 18 of the outside dial plate element 10 and a portion corresponding to the arc of the one part of the periphery of the third opening 18 on the outside surface of the inside dial plate element 11.

The inner peripheral surface 14*b* of the third frame member 14 is tapered so that its diameter increases gradually from an inside end (bottom surface) of the third frame member 14 toward an projecting end (top surface) of the outer projection 14*a*. The tapered inner peripheral surface 14*b* may have a decoration layer. The decoration layer may be provided by any known decoration treatment including engraving, printing, painting, plating, vapor deposition, etc.

The solar panel 5 receives external light transmitted through the outside dial plate element 10 and the inside dial plate element 11 and generates electromotive force. As shown in FIG. 4, the solar panel 5 is formed into a circular flat shape having substantially the same size as the inside dial plate element 11 and is disposed to overlap the inside surface of the inside dial plate element 11. An indicating member driving shaft insertion hole 25, first to third auxiliary driving shaft insertion holes 26, 27 and 28, and an indication opening 29 are formed in the solar panel 5 to correspond to the indicating member driving shaft insertion hole 20, the first to third auxiliary driving shaft insertion holes 21, 22 and 23, and the indication opening 24 in the inside dial plate element 11.

As shown in FIGS. 1 to 4, an indicating member driving shaft 30 extends from the indicating member operating module 3 containing the time counting module up to an outside of the first surface (outside surface) of the outside dial plate element 10 through the indicating member driving shaft insertion hole 25 of the solar panel 5, the indicating member driving shaft insertion hole 20 of the inside dial plate element 11, and the indicating member driving shaft insertion hole 15 of the outside dial plate element 10, and an indicating member 31 is attached to the extending end portion of the indicating member driving shaft 30. The indicating member driving shaft 30 and the indicating member 31 are included in the time indicating portion 6. The indicating member 31 operated by the indicating member operating module 3 including the time counting module through the indicating member driving shaft 30 points any time marks on the peripheral area of the first surface of the outside dial plate element 10 to indicate a time.

In this embodiment, the indicating member driving shaft 30 is configured by a second hand driving shaft element, a minute hand driving shaft element, and an hour hand driving shaft element, these three hand driving shaft elements being disposed coaxial with each other. The indicating member 31 is configured by a second hand 31*a* fixed to the extending end of the second hand driving shaft element, a minute hand 31*b* fixed to the extending end of the minute hand driving shaft element, and an hour hand 31*c* fixed to the extending end of the hour hand driving shaft element.

As shown in FIGS. 1 to 4, a first auxiliary driving shaft 33 extends from the indicating member operating module 3 including the time counting module up to an outside of an area surrounded by the first frame member 12 on the outside surface of the inside dial plate element 11, through the first auxiliary driving shaft insertion hole 26 of the solar panel 5 and the first auxiliary driving shaft insertion hole 21 of the inside dial plate element 11, and a first indicating member 32 attached to the extending end portion of the first auxiliary driving shaft 33. The first auxiliary driving shaft 33 and the first indicating member 32 are included in the first auxiliary indicating portion 7. The first indicating member 32 operated by the indicating member operating module 3 through the first auxiliary driving shaft 33 points any first auxiliary indication marks provided on the aforementioned area on the outside surface of the inside dial plate element 11.

In this embodiment, the first indicating member 32 is a small sized second hand, and the first auxiliary indication marks are second marks. The extending end portion of the first auxiliary driving shaft 33 and the first auxiliary indicating member 32 are not projected out from the first surface (outside surface) of the outside dial plate element 10 through the first opening 16 of the outside dial plate element 10.

In this embodiment, if the indicating member operating module 3 including the time counting module is configured to be able to set a stop watch function, while one of the first indicating member 32 of the first auxiliary indicating portion 7 and the second hand 31*a* of the time indicating portion 6 can function as a second hand of an ordinary time piece, the other can function as a second hand of a stop watch.

As shown in FIGS. 1 to 5, a second auxiliary driving shaft 34 extends from the indicating member operating module 3 including the time counting module up to an outside of an area surrounded by the second frame member 13 on the outside surface of the inside dial plate element 11 through the second auxiliary driving shaft insertion hole 27 of the solar panel 5 and the second auxiliary driving shaft insertion hole 22 of the inside dial plate element 11, and a second auxiliary indicating member 35 is attached to an extending end portion of the second auxiliary driving shaft 34. The second auxiliary driving shaft 34 and the second auxiliary indicating member 35 are included in the second auxiliary indicating portion 8.

In this embodiment, the second auxiliary indicating member 35 is configured by a circular disc on an outside surface of which periodical information such as a tide graph, moon face, day of the week, date and the like is represented periodically in the circumferential direction of the outside surface. The second auxiliary indicating member 35 is operated by the indicating member operating module 3 through the second auxiliary driving shaft 34 and indicates the above-described periodical information periodically in the second opening 17 in the outside surface of the outside dial plate element 10.

The extending end portion of the second auxiliary driving shaft 34 and the second auxiliary indicating member 35 are not projected out from the first surface (outside surface) of the outside dial plate element 10 through the second opening 17 in the outside dial plate element 10.

As shown in FIGS. 1 to 4, 6A, and 6B, a third auxiliary driving shaft 36 extends from the indicating member operating module 3 including the time counting module up to an outside of an area surrounded by the third frame member 14 on the outside surface of the inside dial plate element 11 through the third auxiliary driving shaft insertion hole 28 of the solar panel 5 and the third auxiliary driving shaft insertion hole 23 of the inside dial plate element 11, and a third auxiliary indicating member 37 is attached to an extending end portion of the third auxiliary driving shaft 36. The third auxiliary driving shaft 36 and the third auxiliary indicating member 37 are included in the third auxiliary indicating portion 9.

The extending end portion of the third auxiliary driving shaft 36 and the third auxiliary indicating member 37 are not projected out from the first surface (outside surface) of the outside dial plate element 10 through the third opening 18 in the outside dial plate element 10.

In this embodiment, the third auxiliary indicating portion 9 indicates whether a current time is in the morning (AM) or in the afternoon (PM). In particular, one color indicating one of the morning (AM) and the afternoon (PM) is painted and/or one of a group of any marks indicating 1 to 12 hours in the morning and a group of any marks indicating 13 to 24 hours in the afternoon is marked on the tapered inner peripheral surface 14*b* of the projecting portion 14*a* of the third frame member 14. And, the other color indicating the other of the morning (AM) and the afternoon (PM) is painted and/or the other of the group of any marks indicating 1 to 12 hours in the morning and the group of any marks indicating 13 to 24 hours in the afternoon is marked on a fan-shaped area surrounded by the projecting portion 14*a* on the outside surface of the inside dial plate element 11.

Figure 6A:
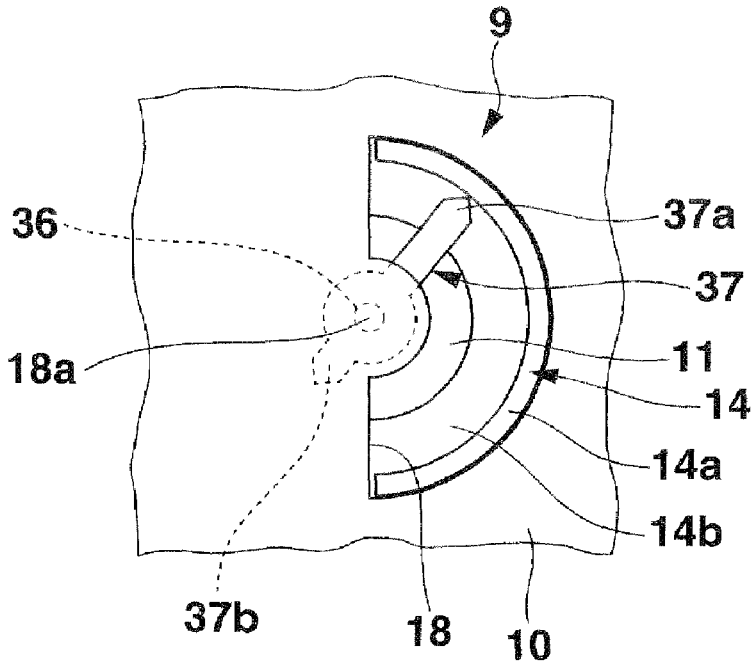
FIG. 6A is an enlarged front view showing a third auxiliary indicating portion and its surrounding area on the dial plate of the dial plate unit shown in FIGS. 1 and 3, wherein an auxiliary indicating member disposed in the third auxiliary indicating portion exposes its long first portion in the third auxiliary indicating portion.
Figure 6B:
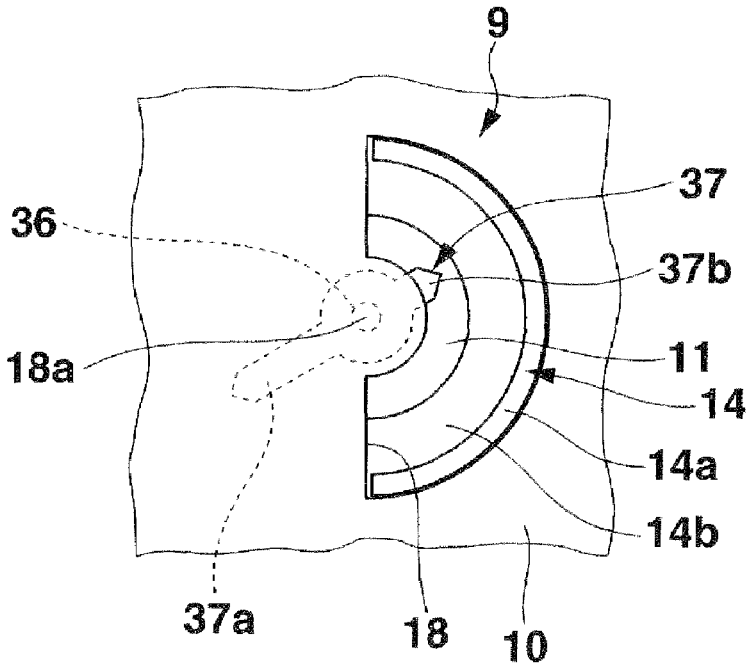
FIG. 6B is an enlarged front view showing the third auxiliary indicating portion and its surrounding area on the dial plate of the dial plate unit shown in FIGS. 1 and 3, wherein the auxiliary indicating member in the third auxiliary indicating portion exposes its short second portion in the third auxiliary indicating portion.

The third auxiliary indicating member 37 includes a first portion 37*a* and a second portion 37*b* extending from the third auxiliary driving shaft 36 in opposite directions along the outside surface of the inside dial plate element 11. The extending length of the first portion 37*a* from the third auxiliary driving shaft 36 and the extending length of the second portion 37*b* from the third auxiliary driving shaft 36 are different from each other. In this embodiment, the extending length of the first portion 37*a* is set so that the extending end thereof reaches the tapered inner peripheral surface 14*b* of the projecting portion 14*a* of the third frame member 14, as shown in FIG. 6A. As shown in FIG. 6B, the extending length of the second portion 37*b* is set so that the extending end thereof reaches the fan-like area surrounded by the projecting portion 14*a* on the outside surface of the inside dial plate element 11.

That is, as shown in FIG. 6A, while the long first portion 37*a* of the third auxiliary indicating member 37 is exposed in the fan-like area surrounded by the projecting portion 14*a* on the outside surface of the inside dial plate element 11 through the third opening 18 of the outside dial plate element 10, its extending end portion indicates predetermined one of the morning (PM) and the afternoon (PM) displayed on the tapered inner peripheral surface 14*b* of the projecting portion 14*a* of the third frame member 14. Further, if the predetermined one of the group of any marks of 1 to 12 hours in the morning and the group of any marks of 13 to 24 hours in the afternoon is marked on the tapered inner peripheral surface 14*b* of the projecting portion 14*a* of the third frame member 14, an hour mark nearest the extending end portion of the long first portion 37*a* in the third opening 18 indicates an approximate current time in the predetermined one of the morning and the afternoon. In the meantime, the short second portion 37*b* of the third auxiliary indicating member 37 is not exposed in the third opening 18 of the outside dial plate element 10 but covered by the outside dial plate element 10.

As shown in FIG. 6B, while the short second portion 37*b* of the third auxiliary indicating member 37 is exposed in the fan-shaped area surrounded by the projecting portion 14*a* on the outside surface of the inside dial plate element 11 through the third opening 18 in the outside dial plate element 10, its extending end portion indicates the predetermined other of the morning (PM) and the afternoon (PM) displayed on the fan-shaped area surrounded by the projecting portion 14*a* on the outside surface of the inside dial plate element 11. Further, if the predetermined other of the group of any marks of 1 to 12 hours in the morning and the group of any marks of 13 to 24 hours in the afternoon is marked on the fan-shaped area surrounded by the projecting portion 14*a* on the outside surface of the inside dial plate element 11, an hour mark nearest the extending end portion of the short second portion 37*b* in the third opening 18 indicates an approximate current time in the predetermined other of the morning and the afternoon. In the meantime, the long first portion 37*a* of the third auxiliary indicating member 37 is not exposed in the third opening 18 of the outside dial plate element 10 but covered by the outside dial plate element 10.

The indicating member operating module 3 including the time counting module includes a known calendar information indicating unit which indicates at least one of day of the week, month, and day through the indication window 19 of the outside dial plate element 10, the indication opening 24 of the inside dial plate element 11 and the indication opening 29 of the solar panel 5.

As apparent from the above detailed description, in the device with the dial plate unit according to the first embodiment of the present invention:

the second hand 31*a*, minute hand 31*b*, and hour hand 31*c* of the indicating member 31 of the time indicating portion 6 are provided to move along the outside surface which is the first surface, of the outside dial plate element 10 of the dial plate 4; and the first to third auxiliary indicating members 32, 35, and 37 of the first to third auxiliary indicating portions 7, 8, and 9 are provided in the first to third openings 16, 17, and 18 of the outside dial plate element 10 between the outside dial plate element 10 and the inside dial plate element 11 to be movable along the areas surrounded by the first to third frame members 12, 13 and 14 on the outside surface of the inside dial plate element 11 spaced at the predetermined distance from the inside surface (the second surface) of the outside dial plate element 10 and facing the second surface.

Figure 7:
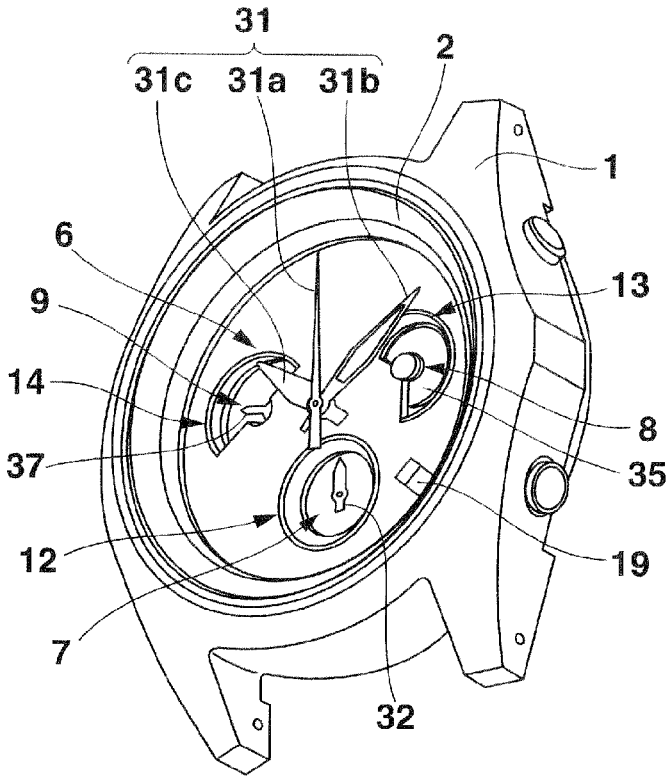
FIG. 7 is a perspective view of a front side of the wrist watch of FIG. 1.
Figure 8:
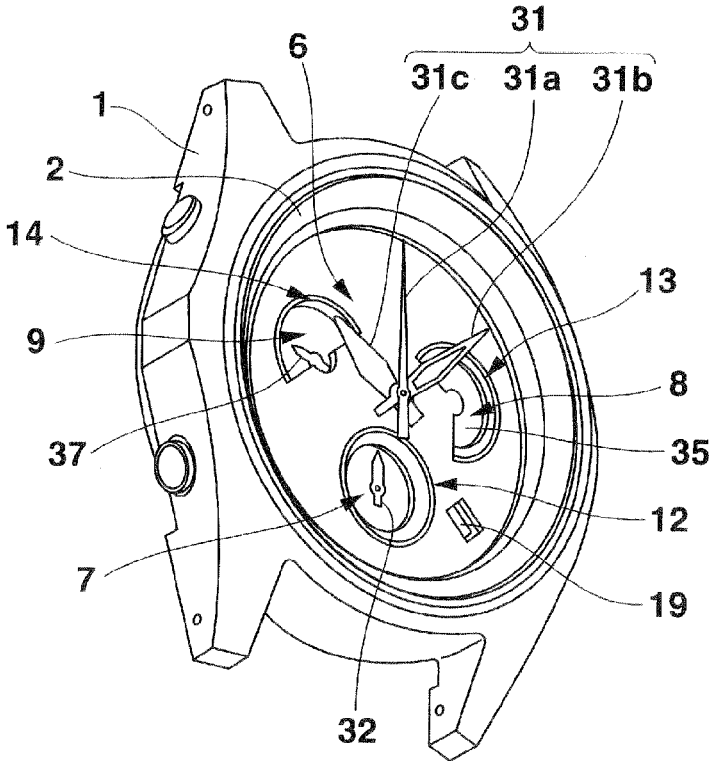
FIG. 8 is a perspective view of the front side of the wrist watch of FIG. 1 as viewed at a different angle from FIG. 7.

Therefore, as shown in FIGS. 7 and 8, a height difference between the second hand 31*a*, minute hand 31*b*, and hour hand 31*c* of the indicating member 31 of the time indicating portion 6 and the first to third auxiliary indicating members 32, 35, and 37 of the first to third auxiliary indicating portions 7, 8, and 9 is large, so that the first to third auxiliary indicating portions 7, 8, and 9 with respect to the time indicating portion 6 have a large three-dimensional appearance. Additionally, the first to third frame members 12, 13, and 14 closes the gaps generated between the peripheries of the first to third openings 16, 17, and 18 of the outside dial plate element 10 and the inside dial plate element 11, and further the inner peripheral surfaces 12*b*, 13*b*, and 14*b* of the first to third frame members 12, 13, and 14 are provided with decoration layers. As a result, the appearance of the dial plate 4 can attract more people when people look the dial plate 4 in the inner space of the wrist watch case 1 through the watch glass 2.

Second Embodiment

Figure 9:
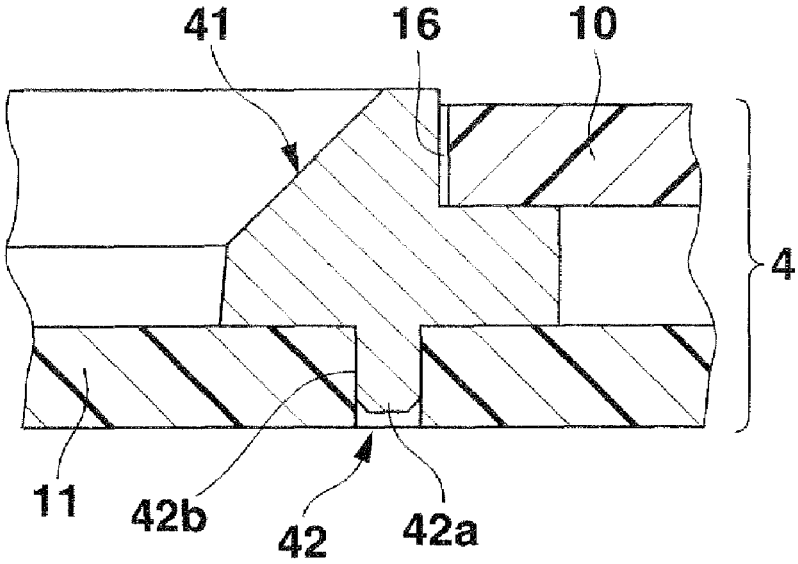
FIG. 9 is an enlarged sectional view of one opening of a dial plate and one frame member arranged in the opening, the dial plate and the frame member being included in a dial plate unit according to a second embodiment of the present invention.

Next, a dial plate unit according to a second embodiment of the present invention will be described with reference to FIG. 9. Most of the structure of the dial plate unit according to the second embodiment is the same as that of the dial plate unit according to the first embodiment described above with reference to FIGS. 1 to 8. The dial plate unit according to the second embodiment of the present invention can be used in the device using the dial plate unit according to the first embodiment of the present invention, instead of the dial plate unit of the first embodiment.

The same structural members or elements of the dial plate unit according to the second embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit according to the first embodiment in that a frame member 41, which is provided in the opening 16 of the outside dial plate element 10 and which closes a gap between at least one part of the periphery of the opening 16 and at least one part of the inside dial plate element 11 corresponding to the at least one part of the periphery of the opening 16, includes a positioning element 42 which positions the frame member 41 to the inside dial plate element 11.

The frame member 41 is formed into a circularly annular shape having an outer peripheral surface the diameter of which is larger than that of the periphery of the opening 16 and an inner peripheral surface the diameter of which is smaller than that of the periphery of the opening 16, and a height between an outside end (top surface) and an inside end (bottom surface) in the frame member 41 is substantially the same as that of the gap between the second surface (inside surface) of the outside dial plate element 10 and the outside surface of the inside dial plate element 11.

The positioning element 42 includes a positioning projection 42*a* formed at a predetermined position of the inside surface (bottom surface) of the frame member 41, the inside surface (bottom surface) coming in contact with the at least one part of the outside surface of the inside dial plate element 11 corresponding to the at least one part of the periphery of the opening 16, and a positioning hole 42*b* formed at a predetermined position of the at least one part of the outside surface of the inside dial plate element 11 corresponding to the at least one part of the periphery of the opening 16.

An outer projection is formed on a part of the outside end (top surface) of the frame member 41, the part corresponding to the periphery of the opening 16, along the inner peripheral surface of the frame member 41.

As shown in FIG. 8, by fitting the positioning projection 42*a* of the frame member 41 into the positioning hole 42*b* of the outside surface of the inside dial plate element 11, the positioning and fixing of the frame member 41 to the above described at least the part on the outside surface of the inside dial plate element 11 is performed.

After that, the outer projection of the frame member 41 is inserted into the opening 16 of the outside dial plate element 10 along the periphery of the opening 16, and a part excluding the outer projection on the outside end (top surface) of the frame member 41 comes in contact with a peripheral area around the opening 16 on the second surface (inside surface) of the outside dial plate element 10. As a result, the frame member 41 is positioned to the opening 16 of the outside dial plate element 10.

Such a positioning element 42 of the frame member 41 as described above can be applied to each of the first to third frame members 12, 13, and 14 of the first embodiment. Particularly, the first frame member 12 provided in the circular first opening 16 of the outside dial plate element 10 rotates easily in the first opening 16 because the outer projection 12*a* of the first frame member 12 to be inserted into the circular first opening 16 is also circular. This rotation can be prevented by adhering the inside end (bottom surface) of the first frame member 12 to the outside end of the inside dial plate element 11 or by adhering the shoulder of the outside end (top surface) of the first frame member 12 to the peripheral area around the opening 16 on the inside surface of the outside dial plate element 10. However, use of adhesive agent is likely to generate adhering failure due to uneven coating of the adhesive agent or oozing out of the adhesive agent from the adhering surfaces. The uneven coating or oozing out of the adhesive agent deteriorates the appearance of the dial plate unit because they can be seen from outside through the transparent or translucent outside dial plate element 10. Further, the adhesive agent and a coating apparatus for coating the adhesive agent complicate a manufacturing line for the dial plate unit.

The positioning element 42 of the frame member 41 solves such a problem related to use of the adhesive agent.

According to the aspect of the present invention, contrary to the above description, the positioning projection 42*a* of the positioning element 42 may be formed at a predetermined position of the at least one part of the outside surface of the inside dial plate element 11, the at least the part of the outside surface corresponding to the at least one part of the periphery of the opening 16, and the positioning hole 42*b* may be formed at a predetermined position of the inside end (bottom surface) of the frame member 41, the inside end (bottom surface) coming in contact with the at least one part of the outside surface of the inside dial plate element 11 corresponding to the at least one part of the periphery of the opening 16.

The frame member 41 may be formed of anticorrosion metal such as brass, aluminum, or the like, or plastic.

The inner peripheral surface of the frame member 41 is tapered like each of the inner peripheral surfaces 12*a*, 13*a*, and 14*a* of the first to third frame members 12, 13, and 14 of the first embodiment, and may have a decoration layer. The decoration layer may be provided by any known decoration treatment including engraving, printing, painting, plating and vapor deposition.

Third Embodiment

Figure 10:
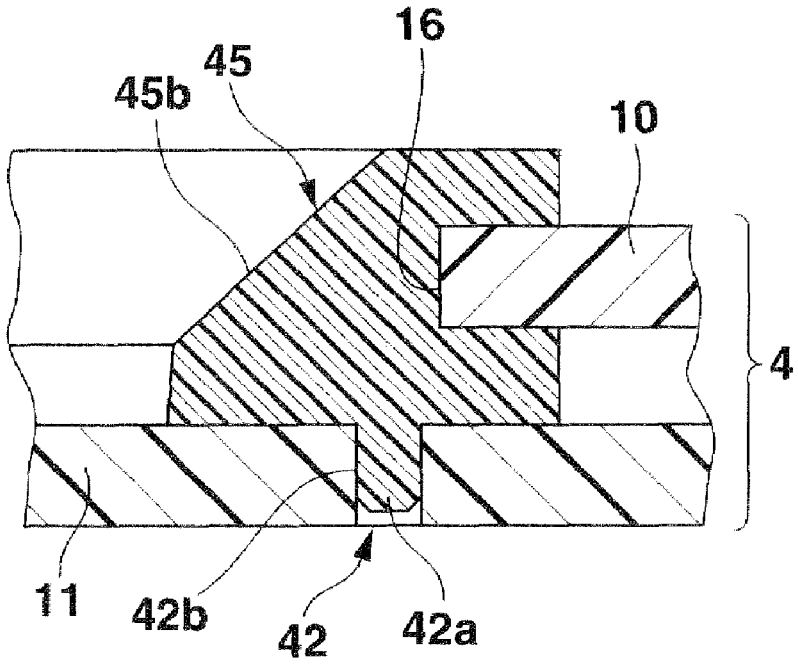
FIG. 10 is an enlarged sectional view of one opening of a dial plate and one frame member arranged in the opening, the dial plate and the frame member being included in a dial plate unit according to a third embodiment of the present invention.

Next, a dial plate unit according to a third embodiment of the present invention will be described with reference to FIG. 10. Most of the structure of the dial plate unit according to the third embodiment is the same as that of the dial plate unit according to the first embodiment described above with reference to FIGS. 1 to 8. The dial plate unit according to the third embodiment of the present invention can be used in the device using the dial plate unit according to the first embodiment of the present invention, instead of the dial plate unit of the first embodiment.

The same structural members or elements of the dial plate unit according to the third embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit according to the first embodiment in that the frame member 45, which is provided in the opening 16 of the outside dial plate element 10 and which closes a gap between at least one part of the periphery of the opening 16 and at least one part of the inside dial plate element 11 corresponding to the at least one part of the periphery of the opening 16, is fixed to the periphery of the opening 16 of the outside dial plate element 10 by an insert molding or a two-color injection molding of resin.

The frame member 45 is formed into a circularly annular shape having an outer peripheral surface the diameter of which is larger than that of the periphery of the opening 16 and an inner peripheral surface the diameter of which is smaller than that of the periphery of the opening 16, and a height between a peripheral region around the opening 16 on the second surface (inside surface) of the outside dial plate element 10 covered with the frame member 45 and an inside end (bottom surface) of the frame member 45 is substantially the same as that of the gap between the second surface (inside surface) of the outside dial plate element 10 and the outside surface of the inside dial plate element 11.

The frame member 45 has the positioning element 42 at its inside end (bottom surface) to position it to the inside dial plate element 11, like the frame member 41 of the dial plate unit according to the second embodiment described above with reference to FIG. 9.

The positioning element 42 includes a positioning projection 42*a* formed at a predetermined position of the inside surface (bottom surface) which comes in contact with at least one part of the outside surface of the inside dial plate element 11 corresponding to at least one part of the periphery of the opening 16, and a positioning hole 42*b* formed at a predetermined position of the at least one part of the outside surface of the inside dial plate element 11 corresponding to the at least one part of the periphery of the opening 16.

The frame member 45 of the dial plate unit according to this embodiment can enjoy various technical advantages provided by the positioning element 42, like the frame member 41 of the dial plate unit according to the second embodiment described above with reference to FIG. 9, and facilitates an installation work of the frame member 45 to the opening 16 of the outside dial plate element 10.

Such a frame member 45 as described above can be applied to each of the first to third frame members 12, 13, and 14 of the first embodiment. Therefore, the inner peripheral surface 45*b* of the frame member 45 is tapered like each of the inner peripheral surfaces 12*a*, 13*a*, and 14*a* of the first to third frame members 12, 13, and 14, and may have a decoration layer.

Fourth Embodiment

Figure 11:
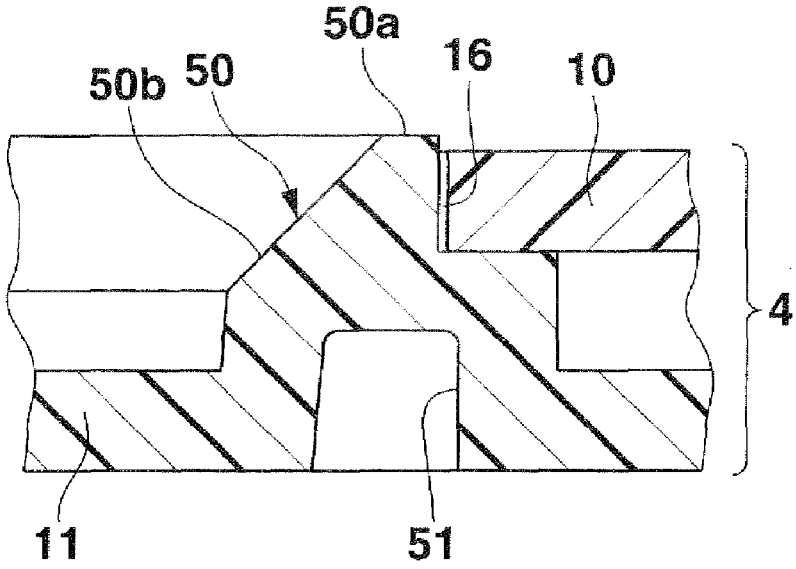
FIG. 11 is an enlarged sectional view of one opening of a dial plate and one frame member arranged in the opening, the dial plate and the frame member being included in a dial plate unit according to a fourth embodiment of the present invention.

Next, a dial plate unit according to a fourth embodiment of the present invention will be described with reference to FIG. 11. Most of the structure of the dial plate unit according to the fourth embodiment is the same as that of the dial plate unit according to the first embodiment described above with reference to FIGS. 1 to 8. The dial plate unit according to the fourth embodiment of the present invention can be used in the device using the dial plate unit according to the first embodiment of the present invention, instead of the dial plate unit of the first embodiment.

The same structural members or elements of the dial plate unit according to the fourth embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit according to the first embodiment in that a frame member 50, which is provided in the opening 16 of the outside dial plate element 10 and which closes a gap between at least one part of the periphery of the opening 16 and at least one part of the inside dial plate element 11 corresponding to the at least one part of the periphery of the opening 16, is formed integrally with the inside dial plate element 11 of the same material as the inside dial plate element 11. The integral forming can be performed by an injection molding, an electroforming method, a press operation or a cutting operation.

The frame member 50 is formed into a circularly annular shape having an outer peripheral surface the diameter of which is larger than that of the periphery of the opening 16 and an inner peripheral surface the diameter of which is smaller than that of the periphery of the opening 16, and a height between an outside end (top surface) and an inside end (bottom surface) in the frame member 50 is substantially the same as that of the gap between the second surface (inside surface) of the outside dial plate element 10 and the outside surface of the inside dial plate element 11.

After performing the injection molding, a contraction preventing concavity 51 is left at a part of the inside surface of the inside dial plate element 11, the part corresponding to the frame member 50. While performing the injection molding, a protrusion of a mold for the injection molding (not shown) is inserted in the contraction preventing concavity 51 to set a change of dimensions of the frame member 50, caused by a contraction of resin while the injection molding is performed, within a tolerable range.

Such a frame member 50 as described above can be applied to each of the first to third frame members 12, 13, and 14 of the first embodiment.

The frame member 50 has an outer projection 50*a* at its outside end (top surface) projecting outward from the outside surface of the inside dial plate element 11, along the inner peripheral surface of the frame member 50, like the outer projections 12*a*, 13*a*, and 14*a* of the first to third frame members 12, 13, and 14 with respect to the first to third openings 16, 17, and 18 in the outside dial plate element 10 according to the first embodiment.

When the outer projection 50*a* is inserted in the opening 16 of the outside dial plate element 10 along the periphery of the opening 16, an area excluding the outer projection 50*a* on the outside end (top surface) of the frame member 50 comes in contact with the peripheral portion around the periphery of the opening 16 on the inside surface of the outside dial plate element 10. As a result, the frame member 50 is positioned to the opening 16 of the outside dial plate element 10.

Further, the inner peripheral surface 50*b* of the frame member 50 is tapered like each of the inner peripheral surfaces 12*a*, 13*a*, and 14*a* of the first to third frame members 12, 13, and 14, and may have a decoration layer.

Although the frame member 50 is molded integrally with the inside dial plate element 11 In this embodiment, it may be molded integrally with the outside dial plate element 10 instead of being molded integrally with the inside dial plate element 11.

Fifth Embodiment

Figure 12:
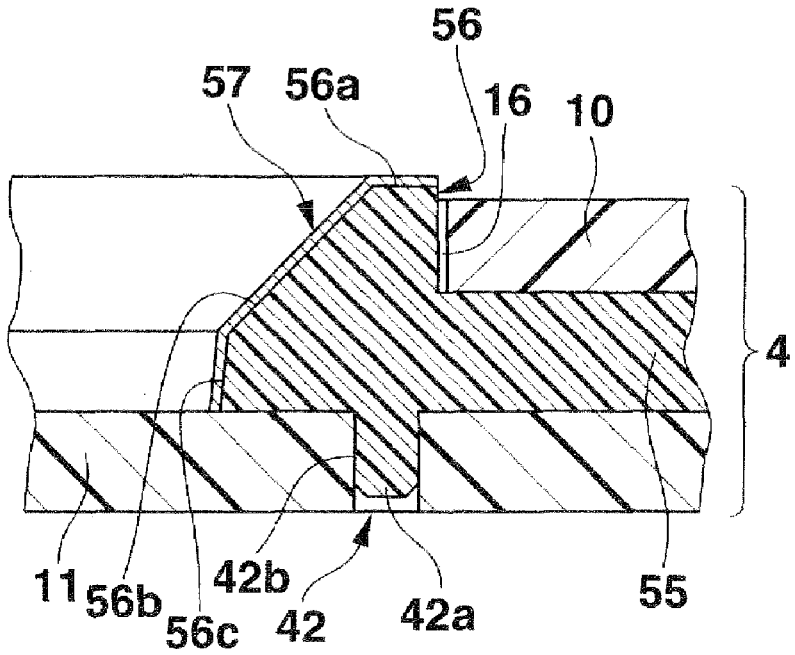
FIG. 12 is an enlarged sectional view of one opening of a dial plate and one frame member arranged in the opening, the dial plate and the frame member being included in a dial plate unit according to a fifth embodiment of the present invention.

Next, a dial plate unit according to a fifth embodiment of the present invention will be described with reference to FIG. 12. Most of the structure of the dial plate unit according to the fifth embodiment is the same as that of the dial plate unit according to the first embodiment described above with reference to FIGS. 1 to 8. The dial plate unit according to the fifth embodiment of the present invention can be used in the device using the dial plate unit according to the first embodiment of the present invention, instead of the dial plate unit of the first embodiment.

The same structural members or elements of the dial plate unit according to the fifth embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit according to the first embodiment in that a frame member supporting plate 55, which is formed of transparent or translucent plastic such as, for example, polycarbonate (PC), polymethyl methacrylate (PMMA) or the like, or inorganic glass, is arranged between the outside dial plate element 10 and the inside dial plate element 11, and that a frame member 56, which is provided in the opening 16 of the outside dial plate element 10 and which closes a gap between at least one part of the periphery of the opening 16 and at least one part of the inside dial plate element 11 corresponding to the at least one part of the periphery of the opening 16, is formed integrally with the frame member supporting plate 55 of the same material as that of the frame member supporting plate 55. The integral forming can be carried out by an injection molding, an electroforming method, a press operation or a cutting operation.

The frame member 56 can be applied to each of the first to third frame members 12, 13, and 14 in the first embodiment. That is, according to this embodiment, a plurality of frame members 56 corresponding to the first to third frame members 12, 13, and 14 for the first to third openings 16, 17, and 18 of the outside dial plate element 10 in the first embodiment can be formed integrally with the frame member supporting plate 55 of the same material as that of the frame member supporting plate 55. This makes a manufacturing and assembly of the dial plate 4 according to this embodiment being easy in comparison to the dial plate 4 according to the first embodiment in which the first to third frame members 12, 13, and 14 are formed individually and the first to third frame members 12, 13, and 14 are disposed respectively in the first to third openings 16, 17, and 18 of the outside dial plate element 10.

Like the outer projections 12*a*, 13*a*, and 14*a* of the first to third frame members 12, 13, and 14 in the first embodiment, an outer projection 56*a* is formed on an outside end (top surface) of the frame member 56 along an inner peripheral surface 56*b* of the frame member 56. Further, the most part of the inner peripheral surface 56*b* of the frame member 56 excluding an inner end portion 56*c* thereof is tapered and has a decoration layer 57, like each of the inner peripheral surfaces 12*a*, 13*a*, and 14*a* of the first to third frame members 12, 13, and 14. The decoration layer 57 may be provided by any known decoration treatment including an engraving, a printing, a painting, a plating, and a vapor deposition.

The frame member 56 includes the positioning element 42 to make a positioning of the frame member 56 to the lower dial plate element 11, like the frame member 41 of the dial plate unit according to the second embodiment described above with reference to FIG. 9.

In this embodiment, the positioning element 42 is provided in an area corresponding to an inside end (bottom surface) of the frame member 56. However, the positioning element 42 may be provided in an area of the frame member supporting plate 55, which is not seen from an outside through the watch glass 2 when a device provided with the dial plate unit according to this embodiment is accommodated in the inner space of the wrist watch case 1 as illustrated in FIG. 1. In this case, the frame member supporting plate 55 is positioned and fixed at a predetermined position of the outside surface of the inner dial plate element 11 by the positioning element 42. Further, like the outer projections 12*a*, 13*a*, and 14*a* of the first to third frame members 12, 13, and 14 to the first to third openings 16, 17, and 18 of the outside dial plate element 10 in the first embodiment, the outer projection 56*a* of the frame member 56 is inserted into the opening 16 of the outside dial plate element 10 along the opening 16 and the outside surface of the frame member supporting plate 55 comes in contact with the second surface (inside surface) of the outside dial plate element 10.

As a result, the frame member 56 is positioned to the opening 16 of the outside dial plate element 10.

Sixth Embodiment

Next, a dial plate unit according to a sixth embodiment of the present invention will be described with reference to FIG. 13. Most of the structure of the dial plate unit according to the sixth embodiment is the same as that of the dial plate unit according to the first embodiment described above with reference to FIGS. 1 to 8. The dial plate unit according to the sixth embodiment of the present invention can be used in the device using the dial plate unit according to the first embodiment of the present invention, instead of the dial plate unit of the first embodiment.

The same structural members or elements of the dial plate unit according to the sixth embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit of the first embodiment in that a frame member 60, which is provided in the opening 16 of the outside dial plate element 10 and which closes a gap between at least one part of the periphery of the opening 16 and at least one part of the inside dial plate element 11 corresponding to the at least one part of the periphery of the opening 16, includes a double-sided adhesive tape 61, which is provided on an inside end (bottom surface) of the frame member 60 and which is as a fixing element for fixing the frame member 60 to at least one part of the outside surface of the inside dial plate element 11. The frame member 60 has a circularly annular shape having an outer peripheral surface the diameter of which is larger than that of the periphery of the opening 16 and an inner peripheral surface the diameter of which is smaller than that of the periphery of the opening 16, Further, at least one part of the outside surface of the inside dial plate element 11 to which the inside end (bottom surface) of the frame member 60 is fixed with the double-sided adhesive tape 61 is flush with an area of the outside surface of the inside dial plate element 11 corresponding to the opening 16 in the outside dial plate element 10, and, together with the area of the outside surface of the inside dial plate element 11, provides a concave portion 62 which is lowered with respect to the other area, surrounding the at least one part of the outside surface of the inside dial plate element 11, of the outside surface of the inside dial plate element 11.

A step 63 between the concave portion 62 and the other area of the outside surface of the inside dial plate element 11 prevents the double-sided adhesive tape 61 between the inside end (bottom surface) of the frame member 60 and the at least one part of the outside surface of the inside dial plate element 11 from protruding into the other area due to a pressing force applied to the double-sided adhesive tape 61, and further prevents an appearance of the dial plate 4 of the dial plate unit according to this embodiment from being deteriorated by the protrusion of the double-sided adhesive tape 61.

The step 63 between the concave portion 62 and the other area of the outside surface of the inside dial plate element 11 allows adhesive agent to be used instead of the double-sided adhesive tape 61.

The frame member 60 includes the positioning element 42 the positioning element 42 to make a positioning of the frame member 60 to the lower dial plate element 11, like the frame member 41 of the dial plate unit according to the second embodiment described above with reference to FIG. 9.

The frame member 60 can be applied to each of the first to third frame members 12, 13, and 14 according to the first embodiment.

An outer projection is formed on the outside end (top surface) of the frame member 60 along the inner peripheral surface of the frame member 60, like the outer projections 12*a*, 13*a*, and 14*a* of the first to third frame members 12, 13, and 14 with respect to the first to third openings 16, 17, and 18 of the outside dial plate element 10 in the first embodiment.

Figure 13:
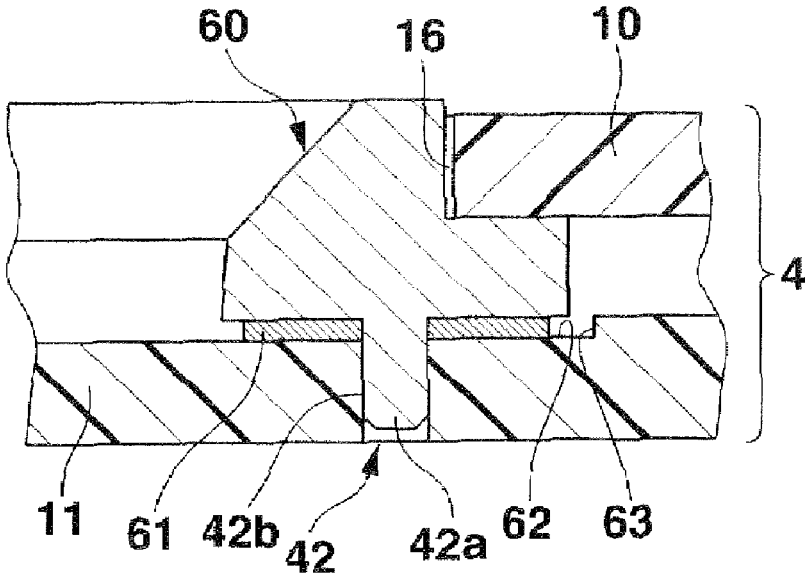
FIG. 13 is an enlarged sectional view of one opening of a dial plate and one frame member arranged in the opening, the dial plate and the frame member being included in a dial plate unit according to a sixth embodiment of the present invention.

As shown in FIG. 13, the positioning projection 42*a* of the frame member 60 is inserted into the positioning hole 42*b* in the outside surface of the inside dial plate element 42*a* so that the frame member 60 is positioned to the outside surface of the inside dial plate element 11 and the inside end (bottom surface) of the frame member 60 is fixed to the at least one part of the outside surface of the inside dial plate element 11 with the double-sided adhesive tape 61. After that, the outer projection of the frame member 60 is inserted into the opening 16 of the outside dial plate element 10 along the periphery of the opening 16 and an area excluding the outer projection in the outside end (top surface) of the frame member 60 comes in contact with the second surface (inside surface) of the outside dial plate element 10. As a result, the frame member 60 is positioned in the opening 16 of the outside dial plate element 10.

The frame member 60 may be formed of anticorrosion metal such as brass, aluminum, or the like, or plastic.

The inner peripheral surface of the frame member 60 is tapered like each of the inner peripheral surfaces 12*a*, 13*a*, and 14*a* of the first to third frame members 12, 13, and 14 of the first embodiment, and may have a decoration layer. The decoration layer may be provided by any known decoration treatment including engraving, printing, painting, plating and vapor deposition.

Seventh Embodiment

Next, a dial plate unit according to a seventh embodiment of the present invention will be described with reference to FIG. 14. Most of the structure of the dial plate unit according to the seventh embodiment is the same as that of the dial plate unit according to the first embodiment described above with reference to FIGS. 1 to 8. The dial plate unit according to the seventh embodiment of the present invention can be used in the device using the dial plate unit according to the first embodiment of the present invention, instead of the dial plate unit of the first embodiment.

The same structural members or elements of the dial plate unit according to the seventh embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit of the first embodiment in that a frame member 65, which is provided in the opening 16 of the outside dial plate element 10 and which closes a gap between at least one part of the periphery of the opening 16 and at least one part of the inside dial plate element 11 corresponding to the at least one part of the periphery of the opening 16, includes a fixing element to fix the frame member 65 to the inside dial plate element 11. The frame member 65 is formed of anti-corrosion metal such as brass, aluminum, or the like.

The frame member 65 has a circularly annular shape having an outer peripheral surface the diameter of which is larger than that of the periphery of the opening 16 and an inner peripheral surface the diameter of which is smaller than that of the periphery of the opening 16, and a height between an outside end (top surface) and an inside end (bottom surface) in the frame member 65 is substantially the same as that of the gap between the second surface (inside surface) of the outside dial plate element 10 and the outside surface of the inside dial plate element 11.

The fixing element includes a positioning projection 66, which is formed at a predetermined position on the inside end (bottom surface) of the frame member 65 to be in contact with at least one part of the outside surface of the inside dial plate element 11 corresponding to at least one part of the periphery of the opening 16, and a positioning through hole 68, which is formed at a predetermined position on the at least one part of the outside surface of the inside dial plate element 11 corresponding to the at least one part of the periphery of the opening 16. A peripheral portion around the positioning through hole 68 on the inside surface of the inside dial plate element 11 is sunk for a spot facing 69.

Figure 14:
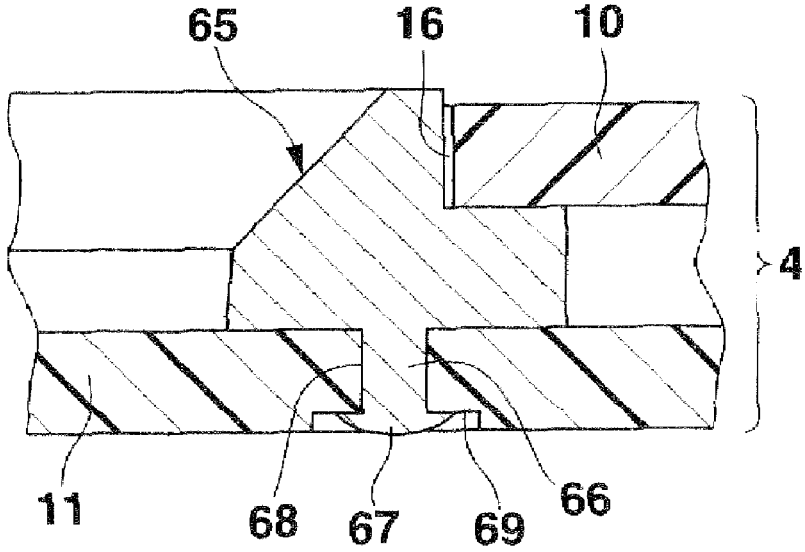
FIG. 14 is an enlarged sectional view of one opening of a dial plate and one frame member arranged in the opening, the dial plate and the frame member being included in a dial plate unit according to a seventh embodiment of the present invention.

As shown in FIG. 14, the positioning projection 66 of the frame member 65 is inserted into the positioning through hole 68 in the outside surface of the inside dial plate element 11, and a projecting end portion 67 of the positioning projection 66 is crushed to engage with the spot facing 69 around the positioning through hole 68 in the inside surface of the inside dial plate element 11. At this time, the crushed projecting end portion 67 of the positioning projection 66 is stayed in the spot facing 69 and does not project out from the inside surface of the inside dial plate element 11.

The combination of the positioning projection 66 and the positioning through hole 68, both of which is included in the fixing element, functions as a positioning element for positioning the frame member 65 to the predetermined position on the outside surface of the inside dial plate element 11.

As shown in FIG. 14, the frame member 65 is positioned at the predetermined position on the outside surface of the inside dial plate element 11 by inserting the positioning projection 66 of the frame member 65 into the positioning through hole 68 in the outside surface of the inside dial plate element 11, and the frame member 65 is fixed to the predetermined position on the outside surface of the inside dial plate element 11 by crushing the projecting end portion 67 of the positioning projection 66 and engaging with the spot facing 69 around the positioning through hole 68 in the inside surface of the inside dial plate element 11.

An outer projection is formed on an outside end (top surface) of the frame member 65 along the inner peripheral surface of the frame member 65. When the outer projection of the frame member 65 is inserted into the opening 16 of the outside disc plate element 10 along the periphery of the opening 16, an area excluding the outer projection on the outside end (top surface) of the frame member 65 comes in contact with the second surface (inside surface) of the outside disc plate element 10. As a result, the frame member 65 is positioned in the opening 16 of the outside disc plate element 10.

The fixing element of such a frame member 65 as described above can be applied to each of the first to third frame members 12, 13, and 14 of the first embodiment as described above.

The frame member 65 may be formed of plastic. In this case, the crush of the projecting end portion 67 of the positioning projection 66 is performed while the projecting end portion 67 is heated.

The inner peripheral surface of the frame member 65 is tapered like each of the inner peripheral surfaces 12*a*, 13*a*, and 14*a* of the first to third frame members 12, 13, and 14 of the first embodiment, and may have a decoration layer. The decoration layer may be provided by any known decoration treatment including engraving, printing, painting, plating and vapor deposition.

Eighth Embodiment

Next, a dial plate unit according to an eighth embodiment of the present invention will be described with reference to FIG. 15. Most of the structure of the dial plate unit according to the eighth embodiment is the same as that of the dial plate unit according to the first embodiment described above with reference to FIGS. 1 to 8. The dial plate unit according to the eighth embodiment of the present invention can be used in the device using the dial plate unit according to the first embodiment of the present invention, instead of the dial plate unit of the first embodiment.

The same structural members or elements of the dial plate unit according to the eighth embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit of the first embodiment in that a frame member 70, which is provided in the opening 16 of the outside dial plate element 10 and which closes a gap between at least one part of the periphery of the opening 16 and at least one part of the inside dial plate element 11 corresponding to the at least one part of the periphery of the opening 16, includes a fixing element for fixing the frame member 70 to the inside dial plate element 11. The frame member 70 is formed of anti-corrosion metal such as brass, aluminum, or the like, or plastic.

The frame member 70 has a circularly annular shape having an outer peripheral surface the diameter of which is larger than that of the periphery of the opening 16 and an inner peripheral surface the diameter of which is smaller than that of the periphery of the opening 16, and a height between an outside end (top surface) and an inside end (bottom surface) in the frame member 70 is substantially the same as that of the gap between the second surface (inside surface) of the outside dial plate element 10 and the outside surface of the inside dial plate element 11.

The fixing element includes a fixing hole 70*a*, which is formed at a predetermined position on the inside end (bottom surface) of the frame member 70 to be in contact with at least one part of the outside surface of the inside dial plate element 11 corresponding to at least one part of the periphery of the opening 16, a positioning through hole 72, which is formed at a predetermined position on the at least one part of the outside surface of the inside dial plate element 11 corresponding to the at least one part of the periphery of the opening 16, and a headed-fixing screw 71, which is inserted into the positioning through hole 72 from a side of the inside surface of the inside dial plate element 11 and an extending end portion of which is screwed in the fixing hole 70*a*.

A peripheral portion around the positioning through hole 72 on the inside surface of the inside dial plate element 11 is sunk for a spot facing 73.

Figure 15:
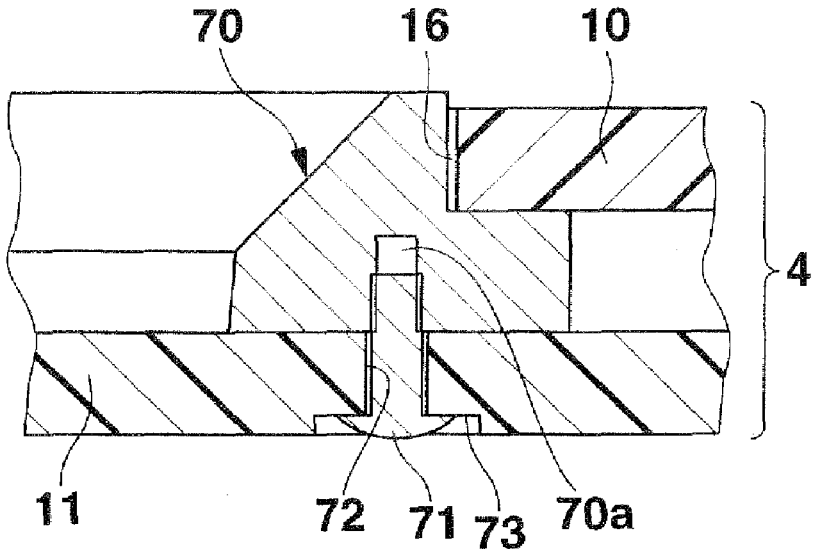
FIG. 15 is an enlarged sectional view of one opening of a dial plate and one frame member arranged in the opening, the dial plate and the frame member being included in a dial plate unit according to an eighth embodiment of the present invention.

As shown in FIG. 15, by screwing the projecting end portion of the headed-fixing screw 71 inserted into the positioning through hole 72 of the inside dial plate element 11 in the fixing hole 70*a* of the frame member 70, the frame member 70 is fixed to the predetermined position on the outside surface of the inside dial plate element 11. At this time, the head of the headed-fixing screw 71 is stayed in the spot facing 73 and does not project out from the inside surface of the inside dial plate element 11.

The combination of the headed-fixing screw 71, the positioning through hole 72 of the inside dial plate element 11, and the fixing hole 70*a* of the frame member 70, three of which is included in the fixing element, functions as a positioning element for positioning the frame member 70 to the predetermined position on the outside surface of the inside dial plate element 11.

An outer projection is formed on an outside end (top surface) of the frame member 70 along the inner peripheral surface of the frame member 70. When the outer projection of the frame member 70 is inserted into the opening 16 of the outside disc plate element 10 along the periphery of the opening 16, an area excluding the outer projection on the outside end (top surface) of the frame member 70 comes in contact with the second surface (inside surface) of the outside disc plate element 10. As a result, the frame member 70 is positioned in the opening 16 of the outside disc plate element 10.

Such a fixing element of the frame member 70 as described above can be applied to each of the first to third frame members 12, 13, and 14 of the first embodiment as described above.

The inner peripheral surface of the frame member 70 is tapered like each of the inner peripheral surfaces 12*a*, 13*a*, and 14*a* of the first to third frame members 12, 13, and 14 of the first embodiment, and may have a decoration layer. The decoration layer may be provided by any known decoration treatment including engraving, printing, painting, plating and vapor deposition.

The fixing element of this embodiment can use a headed-fixing pin instead of the headed-fixing screw 71. The headed-fixing pin inserts its projecting end portion into the positioning through hole 72 of the inside disc plate element 11 to press fit the projecting end portion in the fixing hole 70*a* of the frame member 70 so that the frame member 70 is fixed to the predetermined position on the outside surface of the inside dial plate element 11.

Ninth Embodiment

Next, a dial plate unit according to a ninth embodiment of the present invention will be described with reference to FIG. 16. Most of the structure of the dial plate unit according to the ninth embodiment is the same as that of the dial plate unit according to the first embodiment described above with reference to FIGS. 1 to 8. The dial plate unit according to the ninth embodiment of the present invention can be used in the device using the dial plate unit according to the first embodiment of the present invention, instead of the dial plate unit of the first embodiment.

The same structural members or elements of the dial plate unit according to the ninth embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit of the first embodiment in that a frame member 75, which is provided in the opening 16 of the outside dial plate element 10 and which closes a gap between at least one part of the periphery of the opening 16 and at least one part of the inside dial plate element 11 corresponding to the at least one part of the periphery of the opening 16, includes a fixing element for fixing the frame member 75 to the inside dial plate element 11. The frame member 75 is formed of anti-corrosion metal such as brass, aluminum, or the like, or plastic.

The frame member 75 has a circularly annular shape having an outer peripheral surface the diameter of which is larger than that of the periphery of the opening 16 and an inner peripheral surface the diameter of which is smaller than that of the periphery of the opening 16, and a height between an outside end (top surface) and an inside end (bottom surface) in the frame member 75 is substantially the same as that of the gap between the second surface (inside surface) of the outside dial plate element 10 and the outside surface of the inside dial plate element 11.

The fixing element includes a positioning projection 76, which is formed at a predetermined position on the inside end (bottom surface) of the frame member 75 to be in contact with at least one part of the outside surface of the inside dial plate element 11 corresponding to at least one part of the periphery of the opening 16, and a positioning through hole 78, which is formed at a predetermined position on the at least one part of the outside surface of the inside dial plate element 11 corresponding to the at least one part of the periphery of the opening 16. A peripheral portion around the positioning through hole 78 on the inside surface of the inside dial plate element 11 is sunk for a spot facing 79. An engaging groove 76*a* is formed in an outer peripheral surface of a projecting end portion of the positioning projection 76.

An outer projection is formed on an outside end (top surface) of the frame member 75 along the inner peripheral surface of the frame member 75.

Figure 16:
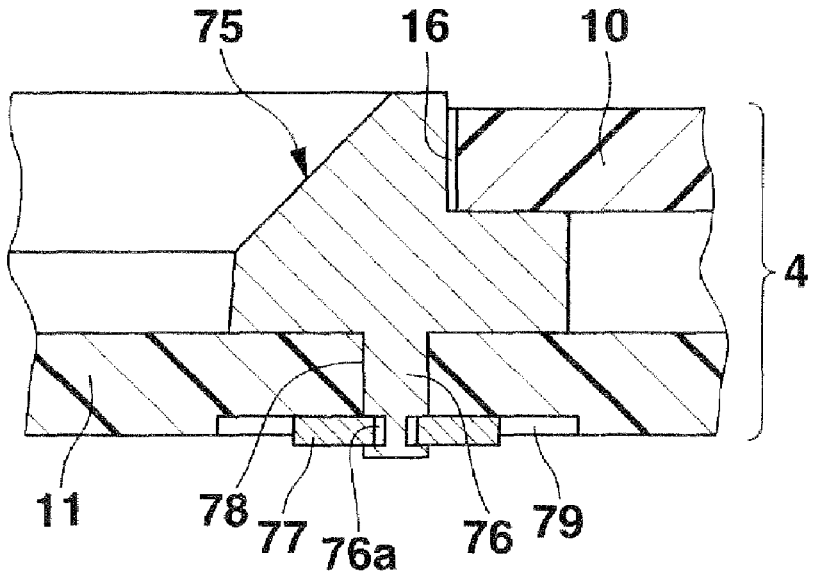
FIG. 16 is an enlarged sectional view of one opening of a dial plate and one frame member arranged in the opening, the dial plate and the frame member being included in a dial plate unit according to an ninth embodiment of the present invention.

As shown in FIG. 16, after the positioning projection 76 of the frame member 75 is inserted into the positioning through hole 68 in the outside surface of the inside dial plate element 11, a fall-out preventing member 77 such as, for example a E-ring, is engaged in the engaging groove 76*a* of the projecting end portion of the positioning projection 76. While the fall-out preventing member 77 engages in the engaging groove 76*a* of the projecting end portion of the positioning projection 76, the fall-out preventing member 77 comes in contact with the bottom of the facing spot 79 around the positioning through hole 78 on the inside surface of the inside dial plate element 11 intimately, so that the fall-out preventing member 77 prevents the positioning pin 76 of the frame member 75 from falling out from the positioning through hole 68 in the outside surface of the inside dial plate element 11 and pulls the positioning projection 76 to press the inside end (bottom surface) of the frame member 75 on an area around the positioning through hole 78 on the outside surface of the inside dial plate element 11. At this time, the fall-out preventing member 77 is stayed in the spot facing 79 and does not project out from the inside surface of the inside dial plate element 11.

The combination of the positioning projection 76 and the positioning through hole 78, both of which is included in the fixing element, functions as a positioning element for positioning the frame member 75 to the predetermined position on the outside surface of the inside dial plate element 11.

As shown in FIG. 16, by inserting the positioning projection 76 of the frame member 75 is inserted into the positioning through hole 78 in the outside surface of the inside dial plate element 11, the frame member 75 is positioned to the predetermined position on the outside surface of the inside dial plate element 11. Then, by engaging the fall-out preventing member 77 such as, for example the E-ring, in the engaging groove 76*a* of the projecting end portion of the positioning projection 76, the frame member 75 is fixed at the predetermined position on the outside surface of the inside dial plate element 11.

After that, the outer projection of the frame member 75 is inserted into the opening 16 of the outside disc plate element 10 along the periphery of the opening 16, an area excluding the outer projection on the outside end (top surface) of the frame member 75 comes in contact with the peripheral area around the opening 16 on the second surface (inside surface) of the outside disc plate element 10. As a result, the frame member 75 is positioned in the opening 16 of the outside disc plate element 10.

Such a fixing element of the frame member 75 as described above can be applied to each of the first to third frame members 12, 13, and 14 of the first embodiment as described above.

The inner peripheral surface of the frame member 75 is tapered like each of the inner peripheral surfaces 12*a*, 13*a*, and 14*a* of the first to third frame members 12, 13, and 14 of the first embodiment, and may have a decoration layer. The decoration layer may be provided by any known decoration treatment including engraving, printing, painting, plating and vapor deposition.

Figure 17:
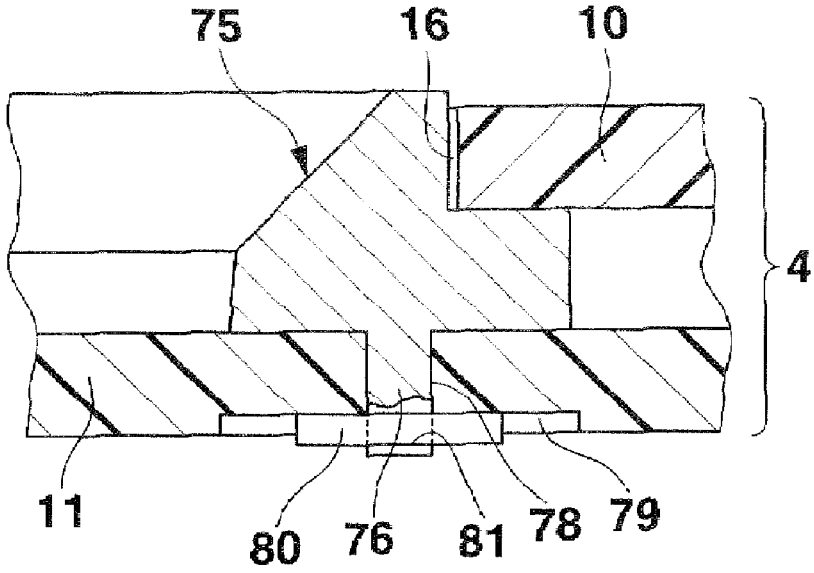
FIG. 17 is an enlarged sectional view of a modification of a combination of the one opening of the dial plate and the one frame member, both of which is included in the dial plate of FIG. 16.

As shown in FIG. 17, the fixing element of this embodiment can use an engaging through hole 81 crossing the positioning projection 76 in a diametrical direction thereof instead of the engaging groove 76*a* in the projecting end portion of the positioning projection, and can use a fall-out preventing member 80 such as, for example an engaging pin, which is to be inserted into engaging through hole 81, instead of the fall-out preventing member 77 such as, for example the E-ring.

When the fall-out preventing member 80 such as, for example the engaging pin, is inserted into the engaging through hole 81 of the projecting end portion of the positioning projection 76 of the frame member 75 along the bottom surface of the facing spot 79 on the inside surface of the inside dial plate element 11, the fall-out preventing member 80 prevents the positioning projection 76 of the frame member 75 from falling out from the positioning through hole 68 in the outside surface of the inside dial plate element 11 and pulls the positioning projection 76 to press the inside end (bottom surface) of the frame member 75 on the area around the positioning through hole 78 on the outside surface of the inside dial plate element 11. At this time, the fall-out preventing member 80 is stayed in the spot facing 79 and does not project out from the inside surface of the inside dial plate element 11.

Tenth Embodiment

Next, a dial plate unit according to a tenth embodiment of the present invention will be described with reference to FIG. 18. Most of the structure of the dial plate unit according to the tenth embodiment is the same as that of the dial plate unit according to the first embodiment described above with reference to FIGS. 1 to 8. The dial plate unit according to the tenth embodiment of the present invention can be used in the device using the dial plate unit according to the first embodiment of the present invention, instead of the dial plate unit of the first embodiment.

The same structural members or elements of the dial plate unit according to the tenth embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit of the first embodiment in that a frame member 85, which is provided in the opening 16 of the outside dial plate element 10 and which closes a gap between at least one part of the periphery of the opening 16 and at least one part of the inside dial plate element 11 corresponding to the at least one part of the periphery of the opening 16, includes a positioning element for positioning the frame member 85 to the inside dial plate element 11 and a fixing element for fixing the frame member 85 to the inside dial plate element 11. The frame member 85 is formed of anti-corrosion metal such as brass, aluminum, or the like, or plastic.

The frame member 85 has a circularly annular shape having an outer peripheral surface the diameter of which is larger than that of the periphery of the opening 16 and an inner peripheral surface the diameter of which is smaller than that of the periphery of the opening 16, and a height between an outside end (top surface) and an inside end (bottom surface) in the frame member 85 is substantially the same as that of the gap between the second surface (inside surface) of the outside dial plate element 10 and the outside surface of the inside dial plate element 11.

The positioning element includes a positioning projection 42*a*, which is formed at a predetermined position on the inside end (bottom surface) of the frame member 85 to be in contact with at least one part of the outside surface of the inside dial plate element 11 corresponding to at least one part of the periphery of the opening 16, and a positioning through hole 42*b*, which is formed at a predetermined position on the at least one part of the outside surface of the inside dial plate element 11 corresponding to the at least one part of the periphery of the opening 16.

The fixing element includes at least one welding projection 86 formed on the onside end (bottom surface) of the frame member 85. If the fixing element includes a plurality of welding projections 86, the welding projections 86 are arranged at a plurality off of positions independent of each other on the onside end (bottom surface) of the frame member 85. Alternatively, the welding projection 86 is formed on the bottom surface along a circular extending direction of the bottom surface to have a circular arc shape or a circle shape. The projecting end of the welding projection 86 is tapered.

An outer projection is formed on the outside end (top surface) of the frame member along the inner peripheral surface of the frame member 85.

Figure 18:
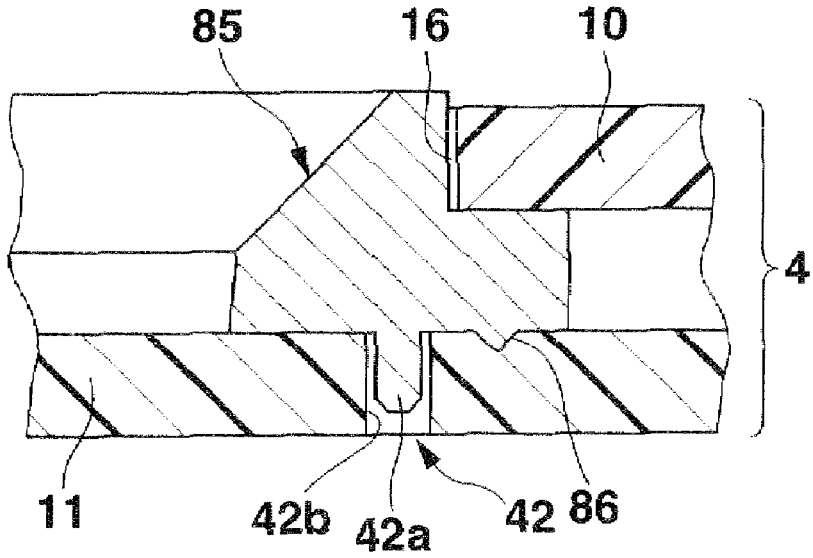
FIG. 18 is an enlarged sectional view of one opening of a dial plate and one frame member arranged in the opening, the dial plate and the frame member being included in a dial plate unit according to an ninth embodiment of the present invention.

As shown in FIG. 18, by inserting the positioning projection 42*a* of the frame member 85 into the positioning through hole 42*b* in the outside surface of the inside dial plate element 11, the frame member 85 is positioned at a predetermined position on the outside surface of the inside dial plate element 11. After that, ultrasonic waves are applied to the welding projection 86 of the frame member 85 to heat the welding projection 86, so that the projecting end of the welding projection 86 melts the outside surface of the inside dial plate element 11 and the melted outside surface of the inside dial plate element 11 is welded to a peripheral area around the welding projection 86 on the inside end (bottom surface) of the frame member 85. That is, the frame member 85 is fixed to the predetermined position on the outside surface of the inside dial plate element 11.

After that, the outer projection of the frame member 85 is inserted into the opening 16 of the outside disc plate element 10 along the periphery of the opening 16, an area excluding the outer projection on the outside end (top surface) of the frame member 85 comes in contact with the peripheral area around the opening 16 on the second surface (inside surface) of the outside disc plate element 10. As a result, the frame member 85 is positioned in the opening 16 of the outside disc plate element 10.

Such a fixing element of the frame member 85 as described above can be applied to each of the first to third frame members 12, 13, and 14 of the first embodiment as described above.

The inner peripheral surface of the frame member 85 is tapered like each of the inner peripheral surfaces 12*a*, 13*a*, and 14*a* of the first to third frame members 12, 13, and 14 of the first embodiment, and may have a decoration layer. The decoration layer may be provided by any known decoration treatment including engraving, printing, painting, plating and vapor deposition.

Eleventh Embodiment

Figure 19A:
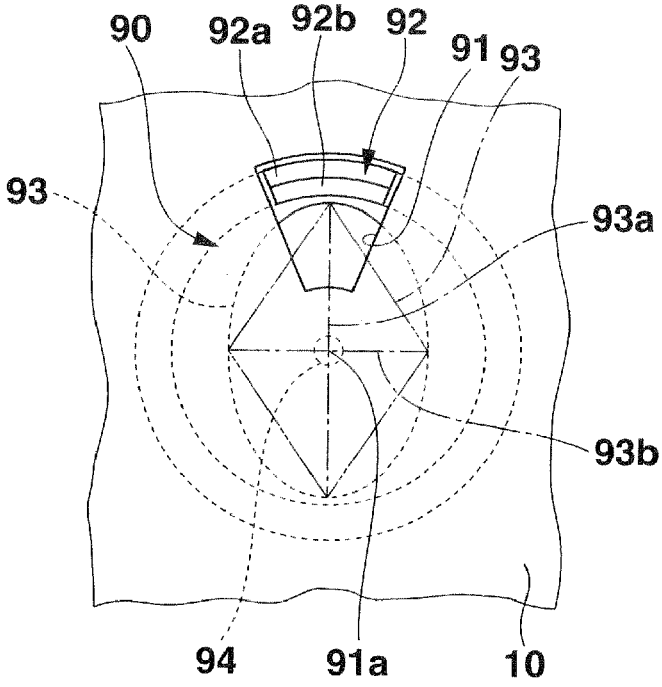
FIG. 19A is an enlarged front view showing a second auxiliary indicating portion and its surrounding area in a dial plate of a dial plate unit according to an eleventh embodiment of the present invention, wherein an oval auxiliary indicating member disposed in the second auxiliary indicating portion exposes its long portion in the second auxiliary indicating portion.
Figure 19B:
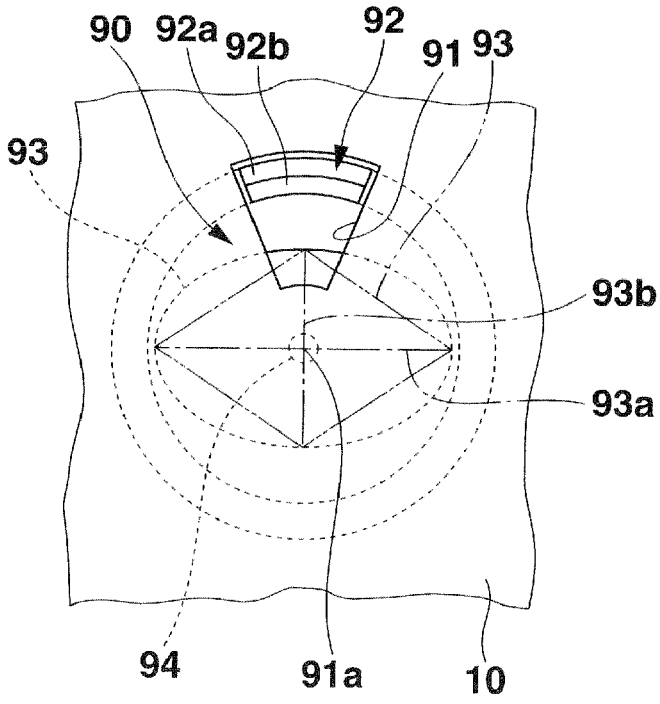
FIG. 19B is an enlarged front view showing the second auxiliary indicating portion and its surrounding area in the dial plate of the dial plate unit according to the eleventh embodiment of the present invention, wherein the oval auxiliary indicating member disposed in the second auxiliary indicating portion exposes its short portion in the second auxiliary indicating portion.

Next, a dial plate unit according to an eleventh embodiment of the present invention will be described with reference to FIGS. 19A and 19B. Most of the structure of the dial plate unit according to the eleventh embodiment is the same as that of the dial plate unit according to the first embodiment described above with reference to FIGS. 1 to 8. The dial plate unit according to the eleventh embodiment of the present invention can be used in the device using the dial plate unit according to the first embodiment of the present invention, instead of the dial plate unit of the first embodiment.

The same structural members or elements of the dial plate unit according to the eleventh embodiment as those of the dial plate unit according to the first embodiment are indicated with the same reference numerals attached to the structural members or elements of the dial plate unit of the first embodiment corresponding thereto, and detailed descriptions thereof are omitted.

The dial plate unit according to this embodiment is different from the dial plate unit of the first embodiment in that a fan shaped opening 91 of an auxiliary indicating portion 90 is formed in the outside disc plate element 10 to have a spreading angle less than 180°, and in this embodiment the spreading angle is an acute angle of for example 30° to 40°.

The auxiliary indicating portion 90 of the dial plate unit according to this embodiment includes a frame member 92 provided to correspond to the opening 91. The frame member 92 is formed into a circularly annular shape coaxial with the center of an arc (namely, the pivot of the fan) 91*a* which is a part of the periphery of the opening 91 of the acute angled fan shape in the outside dial plate element 10. The frame member 92 has an outer peripheral surface the diameter of which is larger than that of the arc of the opening 91 and an inner peripheral surface the diameter of which is smaller than that of the arc of the opening 91. A height between an outside end (top surface) and an inside end (bottom surface) in the frame member 92 is substantially the same as that of the gap between the second surface (inside surface) of the outside dial plate element 10 and the outside surface of the inside dial plate element 11.

The frame member 92 is formed of anti-corrosion metal such as brass, aluminum, or the like, or plastic.

An arc shaped outer projection 92*a* is formed on a part of the outside end (top surface) of the frame member 92, the part corresponding to the arc as the part of the periphery of the opening 91, to project outward along the part of the inner peripheral surface of the frame member 92, the part corresponding to the arc as the part of the periphery of the opening 91, up to the height which is substantially the same as the thickness of the outside dial plate element 10.

When the outer projection 92*a* of the frame member 92 is inserted into the opening 91 of the outside dial plate element 10 along the arc of the one part of the periphery of the opening 91 from the second surface (inside surface) side of the outside dial plate element 10, the outer peripheral surface of the frame member 92*a* comes in contact with the arc of the one part of the periphery of the opening 91 and an area excluding the outer projection 92*a* on the outside end (top surface) of the frame member 92 comes in contact with the second surface (inside surface) of the outside dial plate element 10. As a result, the frame member 92 is positioned to the opening 91 of the outside dial plate element 10.

Further, the whole of the circularly annular shaped inside end (bottom surface) of the frame member 92 comes in contact with the outside surface of the inside dial plate element 11. As a result, the frame member 92 closes the gap between the arc of the one part of the periphery of the opening 91 of the outside dial plate element 10 and a portion corresponding to the arc of the one part of the periphery of the opening 91 on the outside surface of the inside dial plate element 11.

The inner peripheral surface 92*b* of the frame member 92 is tapered so that its diameter increases gradually from an inside end (bottom surface) of the third frame member 14 toward an projecting end (top surface) of the outer projection 92*a*. The tapered inner peripheral surface 92*b* may have a decoration layer. The decoration layer may be provided by any known decoration treatment including engraving, printing, painting, plating, vapor deposition, etc.

An auxiliary indicating member driving shaft 94 extending from the indicating member operating module 3 (see FIG. 2) projects out at a predetermined position of the inside dial plate element 11 corresponding to a center position 91*a* of the arc of the periphery of the opening 91 of the outside dial plate element 10. The projecting end portion of the auxiliary indicating member driving shaft 94 is positioned in the gap between the inside dial plate element 11 and the outside dial plate element 10, and a center of a elongated auxiliary indicating member 93 is attached to the projecting end portion. In this embodiment, the auxiliary indicating member 93 has an oval shape.

A major axis 93*a* of the auxiliary indicating member 93 is shorter than a diameter of the inner end of the inner peripheral surface 92*b* of the frame member 92, the inner peripheral surface 92*b* being along the outer arc of the periphery of the opening 91 of the outside dial plate element 10, and a minor axis 93*b* of the auxiliary indicating member 93 is longer than a diameter of the inner arc of the periphery of the opening 91 of the outside dial plate element 10.

The auxiliary indicating member 93 indicates a degree of at least one of various kinds of environment information including for example temperature, humidity, altitude, atmospheric pressure, and concentration in the atmosphere of some kinds of material, by a degree of an area of the auxiliary indicating member 93 exposing in the opening 91 of the outside dial plate element 10 with a change of rotation angle of the auxiliary indicating member driving shaft 94.

An indication (for example, indication by a color density change or by a numerical change) indicating the degree of at least one selected from the various kinds of environment information including for example temperature, humidity, altitude, atmospheric pressure, and concentration in the atmosphere of some kinds of material, may be provided on an outside surface of the auxiliary indicating member 93 along the circumferential direction of the auxiliary indicating member 93.

[Other Modifications]

Each of the circular disc shaped second auxiliary indicating member 35, which is included in the second auxiliary indicating portion 8 of the dial plate unit according to the first embodiment described above with reference to FIGS. 1 to 8, and the oval shaped auxiliary indicating member 93, which is included in the dial plate unit according to the eleventh embodiment described above with reference to FIGS. 19A and 19B, may be any one of various kinds of polygonal shapes including for example a triangle, a four-side, a pentagon, and others. In FIGS. 19A and 19B, the auxiliary indicating member 93 of the four-sided shape is shown by a two-dots chain line.

Each of the first to third openings 16, 17, and 18, and the opening 91 of the circular shape or the fan shape formed in the outside dial plate element 10 of the dial plate unit in each of all of the embodiments and modifications as described above may be any kind of shape such as an oval, a half oval, a polygonal shape including for example a triangle, a four-side, a pentagon and others, and others. In FIG. 4, the first opening 16 of the four-sided is shown by a two-dots chain line.

Further, the device using the dial plate unit according to each of the various kinds of embodiments and modifications as described above is the portable time piece such as for example the wrist watch, but the device may be a clock to stand on a table or a wall clock, or may be any kind of meter excluding the time piece.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A dial plate unit comprising:

a dial plate including an outside dial plate element which has a first surface and a second surface facing in an opposite direction to the first surface and in which an opening is formed at least in one predetermined position, an inside dial plate element which is spaced at a predetermined distance from the second surface of the outside dial plate element and which is arranged to face the second surface, and a frame member which is provided in the opening of the outside dial plate element and which closes a gap between at least a part of the periphery of the opening and at least a part of the inside dial plate element corresponding to the at least a part of the periphery of the opening;

at least one indicating member which is disposed in a side of the first surface of the outside dial plate element and which is movable along the first surface; and at least one auxiliary indicating member which is disposed in the opening and which is movable between the outside dial plate element and the inside dial plate element.

2. The dial plate unit according to claim 1, further comprising a positioning element which positions the frame member to the inside dial plate element.

3. The dial plate unit according to claim 1, wherein the frame member is integrated with any one of the outside dial plate element and the inside dial plate element.

4. The dial plate unit according to claim 1, further comprising a fixing element which fixes the frame member to the inside dial plate element.

5. The dial plate unit according to claim 1, wherein the frame member has an inner peripheral surface and the inner peripheral surface is provided with a decoration layer.

6. The dial plate unit according to claim 1, wherein the opening of the outside dial plate element has a shape selected from the group consisting of a circle, a fan and a polygon.

7. The dial plate unit according to claim 1, wherein the auxiliary indicating member has a shape selected from the group consisting of a needle, a circle, an oval and a polygon.

8. The dial plate unit according to claim 1, wherein the auxiliary indicating member rotates along the inside dial plate element in the opening, the auxiliary indicating member includes a rotation center, a first portion extending from the rotation center along the inside dial plate element and a second portion extending in a direction different from the extending direction of the first portion from the rotation center along the inside dial plate element, and the extending length of the first portion is different from the extending length of the second portion.

9. A device comprising:

a dial plate including an outside dial plate element which has a first surface and a second surface facing in an opposite direction to the first surface and in which an opening is formed at least in one predetermined position, an inside dial plate element which is spaced at a predetermined distance from the second surface of the outside dial plate element and which is arranged to face the second surface, and a frame member which is provided in the opening of the outside dial plate element and which closes a gap between at least a part of the periphery of the opening and at least a part of the inside dial plate element corresponding to the at least a part of the periphery of the opening;

at least one indicating member which is disposed in a side of the first surface of the outside dial plate element and which is movable along the first surface;

at least one auxiliary indicating member which is disposed in the opening and which is movable between the outside dial plate element and the inside dial plate element; and a indicating member operating module which operates the indicating member and auxiliary indicating member.

10. The device according to claim 9, wherein the indicating member operating module includes a time counting module, the device further comprising:

a portable timepiece case in which an inner space storing the dial plate, the indicating member, the auxiliary indicating member and the indicating member operating module, and an opening exposing the dial plate stored in the inner space are formed; and a light transmission plate which covers the opening of the portable timepiece case.

11. The device according to claim 9, further comprising a positioning element which positions the frame member to the inside dial plate element.

12. The device according to claim 9, wherein the frame member is integrated with any one of the outside dial plate element and the inside dial plate element.

13. The device according to claim 9, further comprising a fixing element which fixes the frame member to the inside dial plate element.

14. The device according to claim 9, wherein the frame member has an inner peripheral surface and the inner peripheral surface is provided with a decoration layer.

15. The device according to claim 9, wherein the opening of the outside dial plate element has a shape selected from the group consisting of a circle, a fan and a polygon.

16. The device according to claim 9, wherein the auxiliary indicating member has a shape selected from the group consisting of a needle, a circle, an oval and a polygon.

17. The device according to claim 9, wherein the auxiliary indicating member rotates along the inside dial plate element in the opening, the auxiliary indicating member includes a rotation center, a first portion extending from the rotation center along the inside dial plate element and a second portion extending in a direction different from the extending direction of the first portion from the rotation center along the inside dial plate element, and the extending length of the first portion is different from the extending length of the second portion.

* * * * *